US009675827B2

(12) United States Patent
Pigeon

(10) Patent No.: US 9,675,827 B2
(45) Date of Patent: Jun. 13, 2017

(54) FIRE SPRINKLER WITH FLUE-PENETRATING NON-CIRCULAR SPRAY PATTERN

(71) Applicant: Firebird Sprinkler Company LLC, Ann Arbor, MI (US)

(72) Inventor: Jeffrey J. Pigeon, Ann Arbor, MI (US)

(73) Assignee: Firebird Sprinkler Company LLC, Ann Arbor, MI (US)

( * ) Notice: Subject to any disclaimer, the term of this patent is extended or adjusted under 35 U.S.C. 154(b) by 0 days.

(21) Appl. No.: 15/134,664

(22) Filed: Apr. 21, 2016

(65) Prior Publication Data

US 2016/0228735 A1 Aug. 11, 2016

Related U.S. Application Data

(60) Division of application No. 14/516,888, filed on Oct. 17, 2014, now Pat. No. 9,381,386, which is a continuation-in-part of application No. 14/096,723, filed on Dec. 4, 2013, now abandoned, which is a continuation of application No. 12/109,221, filed on Apr. 24, 2008, now Pat. No. 8,602,118.

(51) Int. Cl.

| | |
|---|---|
| ***A62C 3/00*** | (2006.01) |
| ***A62C 35/68*** | (2006.01) |
| ***A62C 37/14*** | (2006.01) |
| ***B05B 1/26*** | (2006.01) |

(52) U.S. Cl.

CPC ..... *A62C 35/68* (2013.01); *A62C 3/002* (2013.01); *B05B 1/267* (2013.01); *A62C 37/14* (2013.01)

(58) Field of Classification Search

CPC ..... A62C 3/002; A62C 31/02; A62C 35/68; A62C 37/11; A62C 37/12; A62C 37/14; A62C 37/16; B05B 1/262; B05B 1/265; B05B 1/267

See application file for complete search history.

(56) References Cited

U.S. PATENT DOCUMENTS

| | | | |
|---|---|---|---|
| 241,000 | A | 5/1881 | Granger |
| 269,205 | A | 12/1882 | Grinnell |
| 269,226 | A | 12/1882 | Parmelee et al. |
| 344,673 | A | 6/1886 | Neracher |
| 726,200 | A | 4/1903 | Stover |
| 1,667,425 | A | 4/1928 | Loepsinger |
| 2,025,063 | A | 12/1935 | Loepsinger |
| 2,046,169 | A | 6/1936 | Knight |

(Continued)

FOREIGN PATENT DOCUMENTS

| | | | |
|---|---|---|---|
| NZ | 282686 | A | 7/1998 |

*Primary Examiner* — Darren W Gorman

(74) *Attorney, Agent, or Firm* — Endurance Law Group, PLC

(57) ABSTRACT

A fire sprinkler of the preferred embodiments includes a frame, a trigger, and a deflector. The frame defines a duct to exhaust the flow of a fire suppressing or extinguishing substance, and includes a fastener to fasten the frame to a supply line. The trigger blocks the flow of the fire suppressing or extinguishing substance through the duct during a first mode, and permits the flow of the fire suppressing or extinguishing substance during a second mode. The deflector redirects the flow of the fire suppressing or extinguishing substance into a coverage area. The deflector also at least partially shields the trigger from the dispersal of a fire suppressing or extinguishing substance from an adjacent fire sprinkler and prevents a failure of the trigger.

10 Claims, 15 Drawing Sheets

(56) References Cited

U.S. PATENT DOCUMENTS

| | | | |
|---|---|---|---|
| 2,135,138 | A | 11/1938 | Kendall |
| 2,699,217 | A | 1/1955 | Elmenhorst |
| 2,862,565 | A | 12/1958 | Dukes |
| 3,834,462 | A | 9/1974 | Orloff et al. |
| 3,924,687 | A | 12/1975 | Groos |
| 4,585,069 | A | 4/1986 | Whitaker |
| 4,624,414 | A | 11/1986 | Ferrazza |
| 4,834,186 | A | 5/1989 | Ballard |
| 5,511,621 | A | 4/1996 | Yao |
| 5,579,846 | A | 12/1996 | Meyer et al. |
| 5,584,344 | A | 12/1996 | Meyer et al. |
| 5,609,211 | A | 3/1997 | Meyer et al. |
| 5,628,367 | A | 5/1997 | Truax et al. |
| 5,630,551 | A | 5/1997 | Forcier |
| 5,669,449 | A | 9/1997 | Polan et al. |
| 5,685,376 | A | 11/1997 | Tirronen et al. |
| 5,687,914 | A | 11/1997 | Bosio et al. |
| 5,727,737 | A | 3/1998 | Bosio et al. |
| 5,862,994 | A | 1/1999 | Pounder et al. |
| 5,865,256 | A | 2/1999 | Pounder |
| 5,915,479 | A | 6/1999 | Ponte |
| 6,059,044 | A | 5/2000 | Fischer |
| 6,082,465 | A | 7/2000 | Retzloff |
| 6,374,920 | B1 | 4/2002 | Phillips et al. |
| 6,446,732 | B1 | 9/2002 | Polan |
| 6,554,077 | B2 | 4/2003 | Polan |
| 6,585,054 | B1 | 7/2003 | Thomas et al. |
| 6,715,561 | B2 | 4/2004 | Franson |
| 6,868,917 | B2 | 3/2005 | Meyer et al. |
| 6,889,774 | B2 | 5/2005 | Multer et al. |
| 6,920,937 | B2 | 7/2005 | Neill et al. |
| 6,962,208 | B2 | 11/2005 | Franson et al. |
| 6,976,543 | B1 | 12/2005 | Fischer |
| 2002/0096580 | A1 | 7/2002 | Pahila |
| 2003/0222155 | A1 | 12/2003 | Neil et al. |
| 2005/0045739 | A1 | 3/2005 | Multer |
| 2006/0060361 | A1 | 3/2006 | Pounder et al. |
| 2006/0070745 | A1 | 4/2006 | Polan |
| 2007/0246231 | A1 | 10/2007 | Pahila et al. |

FIRE SPRINKLER WITH FLUE-PENETRATING NON-CIRCULAR SPRAY PATTERN

CROSS REFERENCE TO RELATED APPLICATIONS

This application is a divisional of U.S. patent application Ser. No. 14/516,888, now U.S. Pat. No. 9,381,386, which is a continuation-in-part of U.S. patent application Ser. No. 14/096,723, which is a continuation of U.S. patent application Ser. No. 12/109,221, now U.S. Pat. No. 8,602,118, which is a continuation-in-part of international patent application number PCT/US2006/025278, all of which are incorporated in their entirety by this reference.

This application is also related to international patent application number PCT/US2006/025111, filed on 27 Jun. 2006, and entitled "Fire Sprinkler System and Method of Installation", which is incorporated in its entirety by this reference.

BACKGROUND OF THE INVENTION

Field of the Invention

The invention relates generally to the fire suppression and extinguishment field, and more specifically to a new and improved fire sprinkler in the fire suppression and extinguishment field.

Description of Related Art

Fire sprinkler systems have been used in the United States to protect warehouses and factories for over one hundred years. In a fire sprinkler system, a fire sprinkler is positioned near the ceiling of a room where hot "ceiling jets" spread radially outward from a fire plume. When the temperature at an individual sprinkler reaches a pre-determined value, a thermally responsive element in the sprinkler activates and permits the flow of water as a water jet through a duct toward a deflector. The deflector redirects the water jet into thin streams or "ligaments" that break up into droplets due to surface tension. The water droplets serve three purposes: (1) delivering water to the burning material and reducing the combustion rate, (2) wetting the surrounding material and reducing the flame spread rate, and (3) cooling the surrounding air through evaporation and displacing air with inert water vapor.

When fire sprinklers are located close to each other, the risk of "cold soldering" becomes a concern. Cold soldering occurs when a first fire sprinkler disperses a fire suppressing or extinguishing substance that directly cools a second fire sprinkler and prevents the second fire sprinkler from properly responding and activating. Thus, there is a need in the fire suppression and extinguishment field to create an improved fire sprinkler that reduces or eliminates the risk of cold soldering.

Furthermore, where fire suppressing systems and fire sprinkler components are evaluated in a scientific setting, fire control has been proven to be most effective by maximizing the following system variables: water discharge velocity, k-factor and water droplet size. Fire control is typically improved by: larger diameter supply lines, more (closely-spaced) supply lines, greater water velocity, higher k-factor and/or larger water droplet size. However, addressing these factors has been limited by the constraint of available supply line. Simply designing a prior art spray head so that it is capable of discharging at a greater velocity, or that possesses a higher k-factor, or produces larger droplet sizes is not an option because each increased aspect will require higher supply line pressure and/or larger diameter supply line piping—both of which substantially increase the cost of an installed fire suppression system.

Warehouse settings are a common application of fire suppressing systems with fire sprinkler components. In a warehouse, storage items—often palletized—are frequently stacked or arranged in long rows. Storage items usually represent a significant capital investment in either raw, partially finished or finished good/inventory. An unchecked fire can quickly destroy storage items either by direct combustion, or collaterally be heat, smoke or water. Furthermore, storage items stacked or arranged in long rows often offer an abundant fuel source for a fire to grow and quickly propagate, making it that much more difficult to extinguish the fire. It is therefore of great economic importance to rapidly contain fires detected in warehoused storage items. Fire containment is largely dependent on the delivery of large quantities of rapidly moving water streams composed of relatively large size water droplets. That is to say, early stage fire containment in a warehouse storage setting is maximized when a lot of high velocity water (or other fire suppressing liquid) is sprayed onto the fire source, and the water droplets are as large as possible.

This objective is often frustrated in warehouse storage settings due to the fact that stacked or arranged rows of storage items tend to make it difficult for the water spray to reach an interior fire. When storage items are stacked or arranged in rows, narrow gaps between adjacent storage items are formed. These marrow gaps are often characterized as flues. There are transverse flues and longitudinal flues. Transverse flues are formed in the gaps between adjacent storage items in the same row, whereas longitudinal flues are created in the gap between two adjacent rows when arranged back-to-back. When a fire originates between two rows of storage items, particularly when they are arranged back-to-back (i.e., with a longitudinal flue in between), it is very difficult to reach the fire with water dispersed from a fire sprinkler. The fire produces hot combustion gases that travel upwardly through the narrow flues like a chimney. When the escaping heat is sufficient to activate at least one nearby overhead fire sprinkler, water (or other fire suppressing liquid) will be discharged into the region. In order to be effective, the water must travel down the very same flues that the heat from the fire is rising through. The rising heat, concentrated within the narrow passageways of the flues will vaporize the descending water spray unless sufficient quantities of water and/or large enough droplet sizes can be applied to overpower the heat. The greatest success at fire suppression will be achieved when, at the initial stages of a fire, a maximum amount of water is applied to the flues directly above the fire locus.

There is therefore a need in the art for an improved fire suppression system that will produce larger water droplet size and/or increase water discharge velocity, operating with less lines with the possibility of less pressure and volume depending on final storage occupancy. Also, there is a need in the art for a fire suppression system that will deliver the maximum available amounts of water (or other fire suppressing liquid) onto a fire. And still further, there is a need for a fire suppression system that is uniquely designed to combat fires in warehouse settings where storage items are tightly stacked in rows such that water from an activated fire sprinkler must be directed into narrow flues to reach a fire.

BRIEF SUMMARY OF THE INVENTION

According to one aspect of this invention, a combined storage item and configured fire sprinkler system is provided. The combination comprises a storage item having an overall height. A sprinkler system is disposed above the storage item. The sprinkler system includes an elongated tubular supply line configured as a conduit to carry pressurized fire-suppressing liquid. A fire sprinkler is coupled directly to the supply line to receive an outflow of fire-suppressing liquid from the supply line along an outflow axis. The fire sprinkler includes a deflector configured to disperse the outflow of fire-suppressing liquid in a generally non-circular conical spray to achieve a non-circular coverage area. The non-circular coverage area has a major diameter generally perpendicular to the supply line and a shorter minor diameter generally parallel to the supply line. The sprinkler system is configured and arranged relative to the storage item so that the minor diameter is between about 15% and 67% of the major diameter when measured at the overall height.

According to another aspect of this invention. A fire sprinkler assembly of the type for dispersing a fire suppressing liquid over a non-circular coverage area is provided. The assembly comprises a frame. The frame includes a fastener configured to connect with a supply line so as to receive an outflow of fire-suppressing liquid from the supply line along an outflow axis. A deflector is supported by the frame and configured to disperse the outflow of fire-suppressing liquid in a generally non-circular conical downward spray to achieve a non-circular coverage area below the fire sprinkler assembly. The deflector has an overall width. And a longer overall length that is proportioned so that the resulting minor diameter is between about 15% and 67% of the major diameter. A mid-point of the deflector is generally centered on the outflow axis. The deflector comprises a generally semi-cylindrical body disposed perpendicularly to the outflow axis and is effective to evenly disperse the outflow of fire-suppressing liquid over the non-circular coverage area.

According to a further aspect of this invention, a combined warehouse and configured fire sprinkler system is provided. The combination includes a warehouse that has a floor and a ceiling. At least one storage item is disposed in the warehouse. The storage item has an overall height as measured from the floor. A sprinkler system is disposed adjacent the ceiling in the warehouse. The sprinkler system includes at least first and second elongated tubular supply lines. Each supply line is configured as a conduit to carry pressurized fire-suppressing liquid. The first supply line is arranged generally parallel to the second supply line. The sprinkler system includes a plurality of fire sprinklers. Each fire sprinkler is coupled directly to one of the first and second supply lines to receive a respective outflow of fire-suppressing liquid from the respective the supply line along an outflow axis. Each fire sprinkler includes a deflector configured to disperse the outflow of fire-suppressing liquid in a generally non-circular conical spray to achieve a non-circular coverage area. The non-circular coverage area has a major diameter generally perpendicular to its respective supply line and a shorter minor diameter generally parallel to its supply line. The sprinkler system is configured and arranged relative to the storage item so that the minor diameter is between about 15% and 67% of the major diameter when measured at the overall height. And the spacing between the first supply line and the second supply line is approximately equal to the major diameter when measured at the overall height.

This invention provides an improved fire sprinkler that is capable of operating with fewer supply lines than was possible using prior art techniques. Even operating through fewer supply lines, the improved fire sprinkler may be effectively operated with less pressure and volume depending on final storage occupancy. This improved fire sprinkler has the capability to produce larger water droplet sizes and/or increased water discharge velocity. The fire suppression system of this invention can be implemented so as to deliver the maximum available amounts of water (or other fire suppressing liquid) onto a fire. And still further, this invention is uniquely designed to combat fires in warehouse settings where storage items are tightly stacked or arranged and water from activated fire sprinklers must travel into narrow flues to reach a fire.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

The following description of the preferred embodiments of the invention is not intended to limit the invention to these preferred embodiments, but rather to enable any person skilled in the art of fire suppression and extinguishment to make and use this invention.

Figure 1:
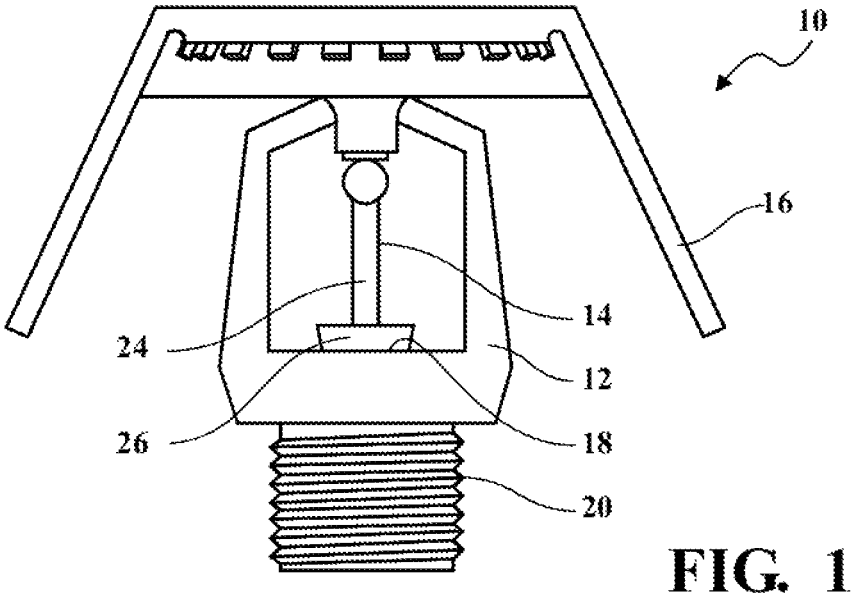
FIG. 1 is a front elevation view of the fire sprinkler according to one embodiment of this invention.
Figure 2:
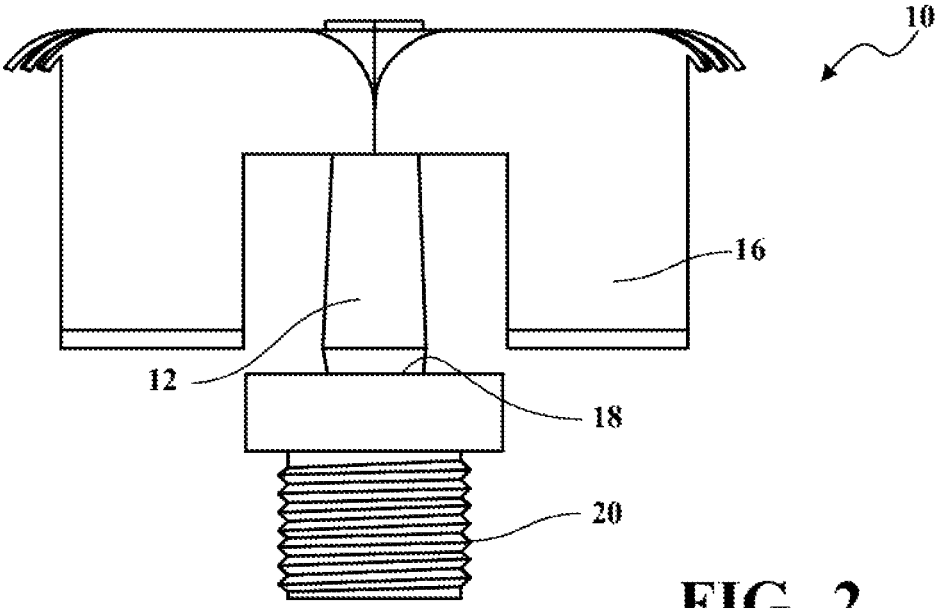
FIG. 2 is a side elevation view of the fire sprinkler shown in FIG. 1.

As shown in FIGS. 1 and 2, the fire sprinkler 10 of the preferred embodiments includes a frame 12, a trigger 14, and a deflector 16. The frame 12 defines a duct 18 to exhaust the flow of a fire suppressing or extinguishing substance, and includes a fastener 20 to fasten the frame 12 to a supply line. The trigger 14 blocks the flow of the fire suppressing or extinguishing substance through the duct 18 during a first mode, and permits the flow of the fire suppressing or extinguishing substance during a second mode. The deflector 16 redirects the flow of the fire suppressing or extinguishing substance into a coverage area. The deflector 16 also at least partially shields the trigger 14 from the dispersal of a fire suppressing or extinguishing substance from an adjacent fire sprinkler 10 and prevents a failure of the trigger 14.

Figure 3:
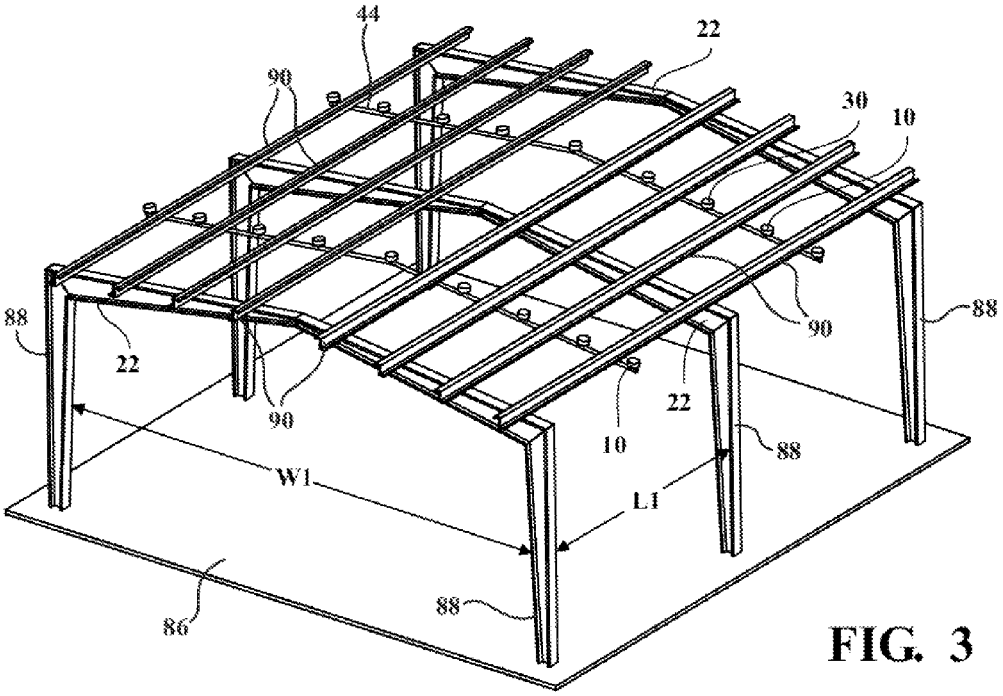
FIG. 3 is a perspective view of the fire sprinkler system according to the preferred embodiments disposed in a building structure, such as a warehouse for storing articles.
Figure 4:
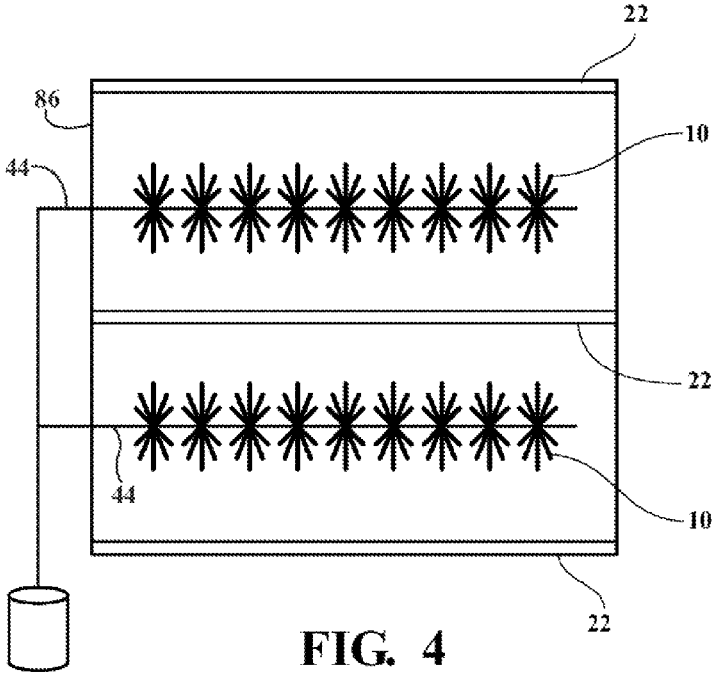
FIG. 4 is an overhead view of the fire sprinkler system and building structure of FIG. 3.

As shown in FIGS. 3 and 4, the fire sprinkler 10 of the preferred embodiments is preferably installed in a space having a width W1 of at least 20 feet (6 m) and a length L1 of at least 20 feet (6 m), and is more preferably installed in a space having a width of at least 20 feet (6 m) and a length of approximately 25 to 30 feet (7.5 m to 9 m). The space is preferably defined by two beams 22 extending along the width of the space and separated by a distance equal to the length of the space. The beams 22 function to support the weight of the roof (not shown). The beams 22 are preferably steel I-shaped rafters, but the beams 22 may be any suitable structural member to transfer the weight of the roof, may be made from any suitable material, and may be shaped in any suitable manner. Preferably, the fire sprinkler 10 is installed in a metal building, but the fire sprinkler 10 may alternatively be installed in any suitable shelter.

As shown in FIGS. 1 and 2, the frame 12 of the preferred embodiments functions to support the other elements of the fire sprinkler 10. The frame 12 preferably defines the duct 18 that functions to exhaust the flow of a fire suppressing or extinguishing substance. The duct 18 may include a nozzle or other suitable restriction. The frame 12 may, however, include any suitable method or device to exhaust the flow of a fire suppressing or extinguishing substance. The fire sprinkler 10 preferably includes a discharge k factor of 5.0 to 25, but may include a discharge k factor of any suitable number depending on the specific application of the fire sprinkler 10. The frame 12 preferably includes a fastener 20 (e.g., threads) that functions to fasten the frame 12 to a supply line. The supply line functions to supply a fire suppressing or extinguishing substance (e.g., water) to the fire sprinkler 10. The frame 12 may, however, include any suitable method or device to fasten the frame 12 to a supply line. The frame 12 is preferably made of metal, but may alternatively be made from any suitable material.

The trigger 14 of the preferred embodiments, which is connected to the frame 12, functions to block the flow of the fire suppressing or extinguishing substance through the duct 18 during a first mode, and to permit the flow of the fire suppressing or extinguishing substance during a second mode. The trigger 14 preferably includes a thermally responsive element 24 and a closure 26. During the first mode, the thermally responsive element 24 functions to restrain the closure 26, while the closure 26 functions to block the flow of the fire suppressing or extinguishing substance through the duct 18. During the second mode, the thermally responsive element 24 responds to the hot "ceiling jets" spreading radially outward from a fire plume and releases the closure 26, thereby permitting the flow of the fire suppressing or extinguishing substance. The thermally responsive element 24 is preferably a glass bulb, but may alternatively be a soldered link or any other suitable device or method. The trigger 14 may also include an o-ring, a Belleville spring, or any other suitable device between the thermally responsive element 24 and the frame 12. The trigger 14 may alternatively include any suitable method or device to block the flow of the fire suppressing or extinguishing substance through the duct 18 during a first mode, and to permit the flow of the fire suppressing or extinguishing substance during a second mode.

Figure 5:
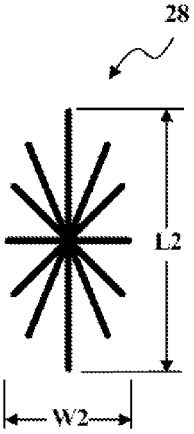
FIG. 5 is a schematic view of the coverage area of a single fire sprinkler according to the preferred embodiments.

As shown in FIG. 5, the deflector of the preferred embodiments, which is connected to the frame, functions to redirect the flow of the fire suppressing or extinguishing substance into a coverage area 28 having a length L2 and a width W2. Preferably, the width W2 of each coverage area 28 is less than the length L2 of each coverage area 28. In a first variation, the width W2 of each coverage area 28 is less than 66% of the length L2 of each coverage area 28. In a second variation, the width W2 of each coverage area 28 is less than 33% of the length L2 of each coverage area 28. In a third variation, the length L2 of each coverage area 28 is at least 20 feet and the width W2 of each coverage area 28 is approximately 4 to 8 feet. In alternative variations, the length L2 and the width W2 of each coverage area may be any suitable dimension.

When the fire sprinkler 10 is located close to an adjacent fire sprinkler 30 (as shown in FIGS. 3 and 4), the dispersal of a fire suppressing or extinguishing substance from the adjacent fire sprinkler 30 may directly cool the fire sprinkler 10 and prevent the trigger 14 from properly responding to the fire and releasing the closure 26. As shown in FIGS. 1 and 2, the deflector 16 of the preferred embodiments also functions to reduce or eliminate this risk. Preferably, the deflector 16 accomplishes this function by at least partially shielding the trigger 14 from the dispersal of a fire suppressing or extinguishing substance from the adjacent fire sprinkler 30. Given that the duct 18 defines a first direction for the flow of the fire suppressing or extinguishing substance and the thermally responsive element 24 extends along this first direction, the deflector 16 preferably extends in a second direction, which is opposite the first direction, past at least a portion of the thermally responsive element 24. More preferably, as shown in FIG. 1, the deflector 16 extends in the second direction completely past the thermally responsive element 24. Alternatively, the deflector 16 may accomplish the function of reducing or eliminating the risk of cold soldering in any suitable method or design.

Figure 6:
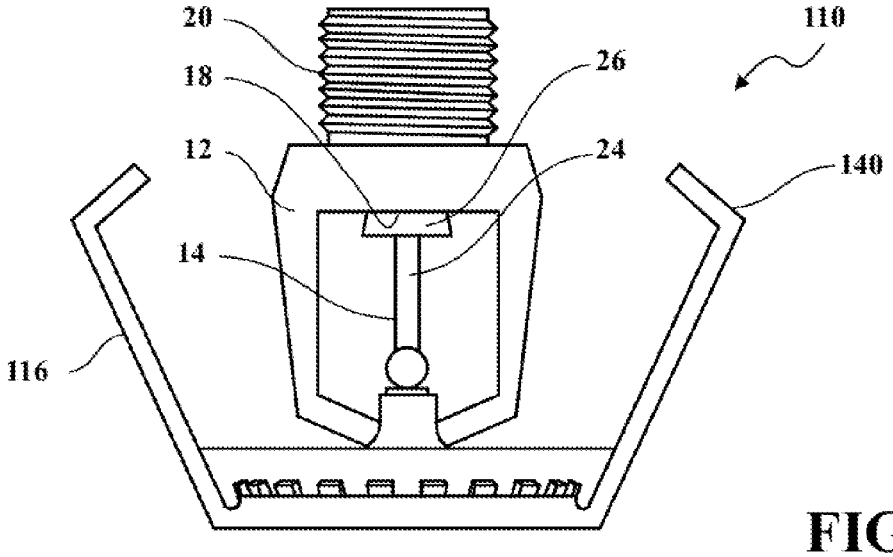
FIG. 6 is a side elevation view of a fire sprinkler according to a first variation of the preferred embodiments.

As shown in FIG. 6, the fire sprinkler 110 of a first variation of the preferred embodiments is arranged as a pendant-type sprinkler, instead of an upright-type sprinkler. The fire sprinkler 110 of the first variation preferably includes the same components as the fire sprinkler 10 with the exception of the deflector 116. The deflector 116 preferably includes an inwardly bent portion 140 that further aids in shielding the trigger 14 from the dispersal of a fire suppressing or extinguishing substance from the adjacent fire sprinkler 30.

Figure 7:
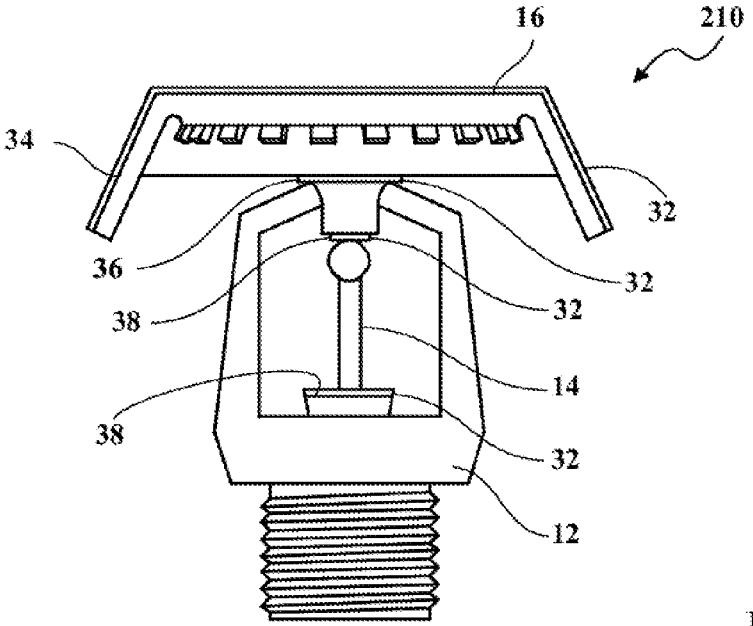
FIG. 7 is a side elevation view of a fire sprinkler according to a second variation of the preferred embodiments.

As shown in FIG. 7, the fire sprinkler 210 of a second variation of the preferred embodiments also includes one or more thermal insulators 32. The thermal insulator 32 functions to further reduce or eliminate the risk of cold soldering. Preferably, the thermal insulator 32 accomplishes this function by reducing or eliminating heat transfer from the trigger 14, through the frame 12, through the deflector 16, and into a fire suppressing or extinguishing substance dispersed onto the deflector 16. The thermal insulator 32 may be placed in several different locations on the fire sprinkler 210. In a first variation, the thermal insulator 32 is a coating 34 on the exterior surface of the deflector 16. The coating 34 is preferably a ceramic or silicon based material, but may be any suitable material to reduce or eliminate heat transfer between the deflector 16 and the fire suppressing or extinguishing substance dispersed onto the deflector 16. In a second variation, the thermal insulator 32 is a deflector coupling 36 between the deflector 16 and the frame 12. The deflector coupling 36 is preferably an insert made of rubber or silicon based material, but may be any suitable device made of any suitable material to reduce or eliminate heat transfer between the frame 12 and the deflector 16. In a third variation, the thermal insulator 32 is a trigger coupling 38 between the trigger 14 and the frame 12. The trigger coupling 38 is preferably one or more bushings made of rubber or silicon based material located at either or both ends of the trigger 14, but may be any suitable device made of any suitable material to reduce or eliminate heat transfer between the trigger 14 and the deflector 16.

Figure 8:
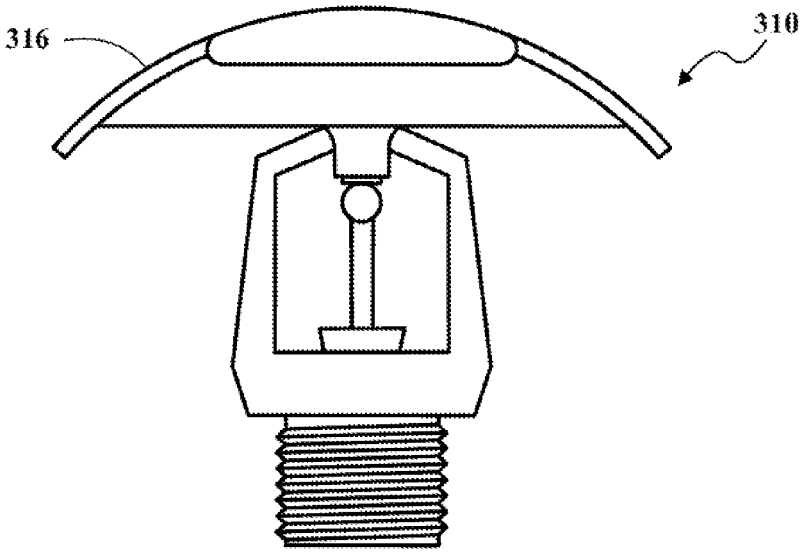
FIG. 8 is a front elevation view of a fire sprinkler according to a third variation of the preferred embodiments.
Figure 9:
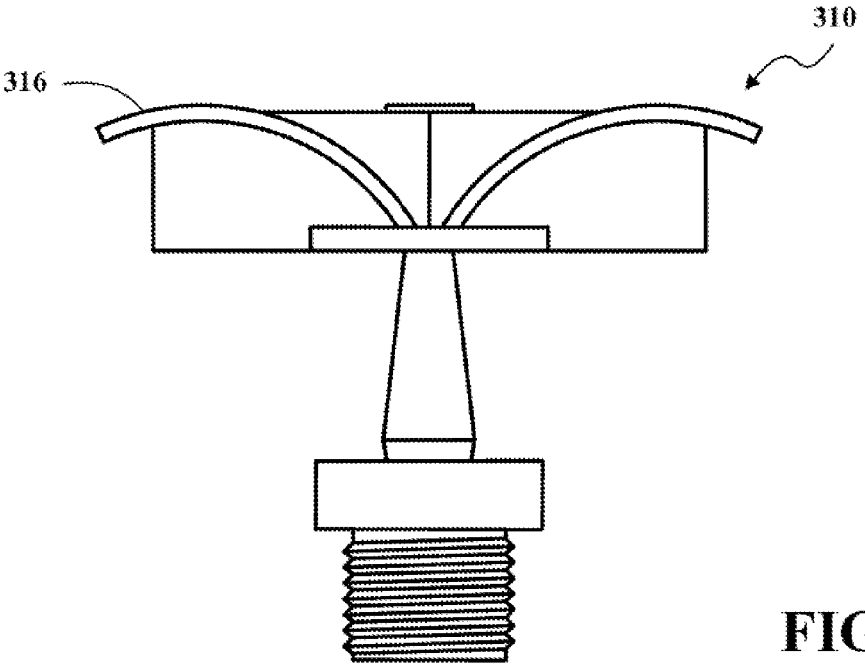
FIG. 9 is a side elevation view of the fire sprinkler of FIG. 8.
Figure 10:
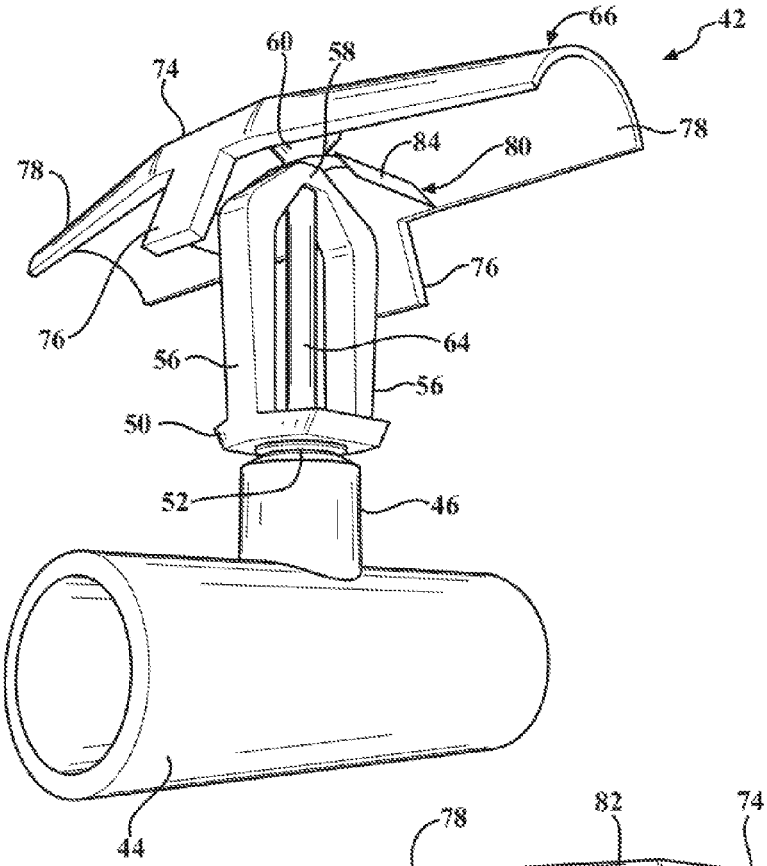
FIG. 10 is a perspective view of a fire sprinkler according to a fourth variation of the preferred embodiments.
Figure 11:
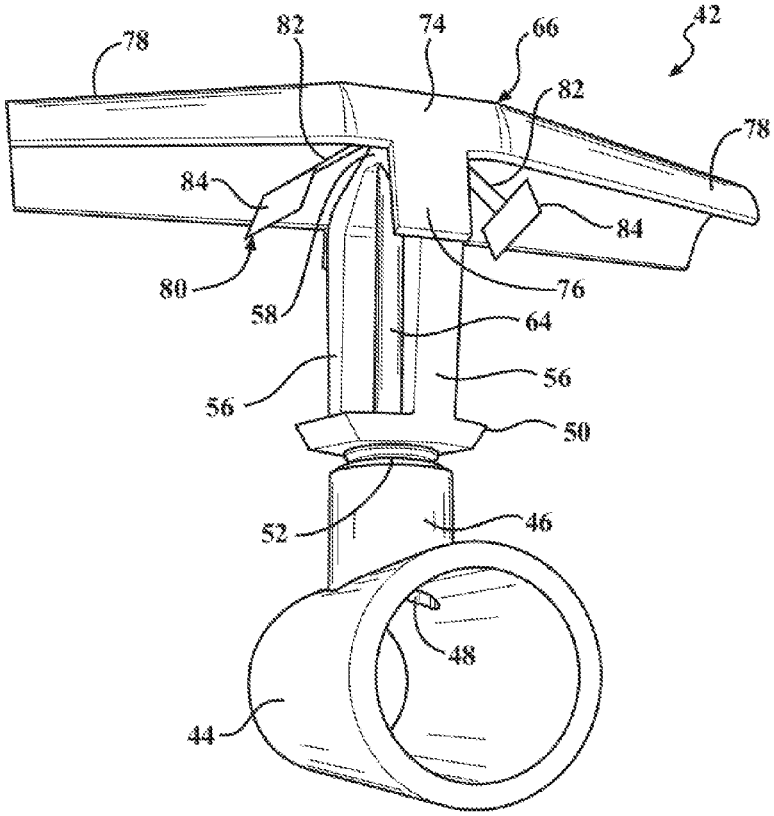
FIG. 11 is another perspective view of the fire sprinkler of FIG. 10.

As shown in FIGS. 8 and 9, the fire sprinkler 310 of a third variation of the preferred embodiments includes a modified deflector 316, but otherwise preferably includes the same components as the fire sprinkler 10. Like the deflector 16, the modified deflector 316 redirects the flow of the fire suppressing or extinguishing substance into a coverage area and at least partially shields the trigger 14 from the dispersal of a fire suppressing or extinguishing substance from an adjacent fire sprinkler 10 and prevents a failure of the trigger 14. The modified deflector 316, however, includes a complex curvature defining a first pair of adjacent arcs in one direction and second pair of adjacent arcs in a perpendicular direction. All four arcs preferably originate near the center of the flow of a fire suppressing or extinguishing substance. The first pair of adjacent arc redirects the flow of the fire suppressing or extinguishing substance in the direction of the width (or the "short" side) of the coverage area 28, while the second pair of adjacent arcs redirects the flow of the fire suppressing or extinguishing substance in the direction of the length (or the "long" side) of the coverage area 28. The geometries of the arcs (e.g., the height, length, and curvature) are preferably chosen based on the specific application and environment of the sprinkler (e.g., the flow rate of the fire suppressing or extinguishing substance, the distance and height of storage containers in the proximity of the sprinkler, and other suitable factors).

Turning now to FIGS. 10-16, a fourth variation of the present invention comprises a fire sprinkler, also known as a sprinkler head, generally shown at 42. The fire sprinkler 42 is part of an installed active fire suppression system disposed in a warehouse or other space needing a high level of protection. The sprinkler system includes an elongated tubular supply line 44 configured as a conduit to carry pressurized fire-suppressing liquid, such as water or other suitable material. Fire sprinklers 42 are disposed in series along the supply line 44 at regular intervals of about four-to-eight feet depending on design criteria. At the location where each fire sprinkler 42 is intended to adjoin the supply line 44, a saddle 46 is fitted in place. Each saddle 46 perpendicularly intersects the supply line 44.

Figure 15:
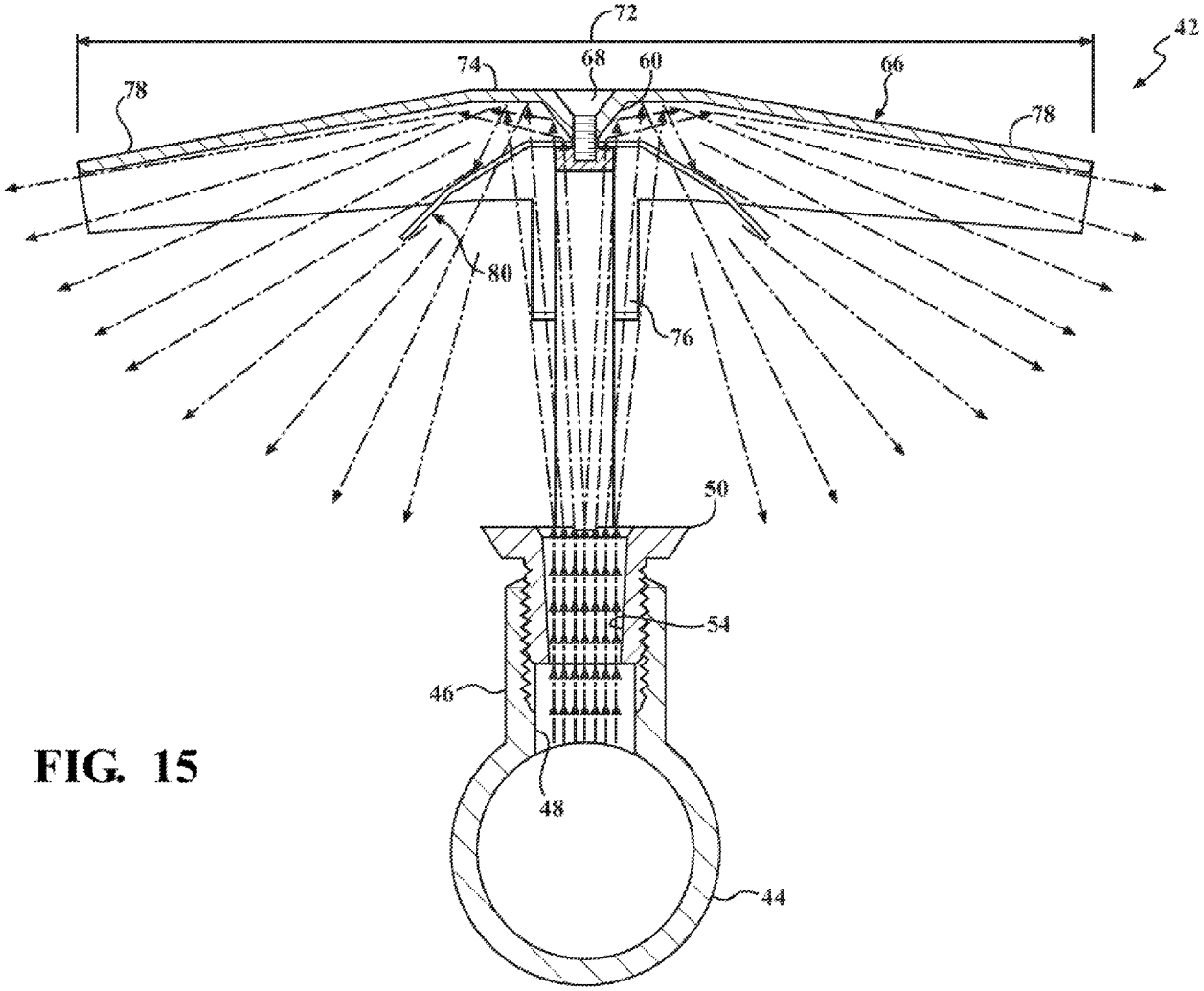
FIG. 15 is a cross-sectional view of the fire sprinkler taken generally along lines 15-15 of FIG. 14 depicting distribution of the fire suppressing liquid along the major diameter of its non-circular coverage area.

As perhaps best shown in FIG. 15, the saddle 15 is provided with a central aperture 48 that fluidly connects with the internal conduit region of the supply line 44 so that an outflow of fire-suppressing liquid can travel from the supply line 44 into the central aperture 48 when the sprinkler head 42 is activated. The surrounding body of the central aperture 48 has a threaded interior surface that is designed to mate with external threads of the sprinkler 42 as will be described subsequently. During fabrication of a fire sprinkler system, the installer will typically drill holes in the supply line 44 at the locations where fire sprinklers 42 are desired. Saddles 46 are then welded or otherwise sealed to the supply line 44 over the drilled holes. Finally, fire sprinklers 42 are screwed into respective saddles 46 prior (or subsequent) to hanging the supply line 44 from the supporting structure in warehouse or other building structure similar to that shown in FIG. 3.

FIGS. 10-13 provide views of the fire sprinkler 42 from various vantages. From these, it can be seen that the fire sprinkler 42 includes a frame 50. The bottom-most portion of the frame 50 comprises a fastener 52 that is configured to connect with the central aperture 48 of the saddle 46. The fastener 52 may take many different forms, but in the illustrated embodiment has a threaded exterior body that mates with the internal thread structure in the central aperture 48 of the saddle 46. The threaded exterior body surrounds a duct 54, as perhaps best shown in the cross-section of FIG. 15. The duct 54 receives a flow of fire-suppressing liquid from the supply line 44 (through the saddle 46) along an outflow axis A that is generally perpendicular to the supply line 44. That is, the perpendicular orientation of the saddle 46 establishes the flow path of liquid that is directed into the duct 54 of the fire sprinkler 42. This flow path determines an outflow axis A which extends generally perpendicular to the longitudinal extent of the supply line 44. In practice, the outflow axis A is oriented vertically within a building structure. In at least one possible application of the present invention, the fire system is oriented so the flow path of liquid that is directed into the duct 54 of the fire sprinkler 42 travels in a vertically upward direction.

Figure 16:
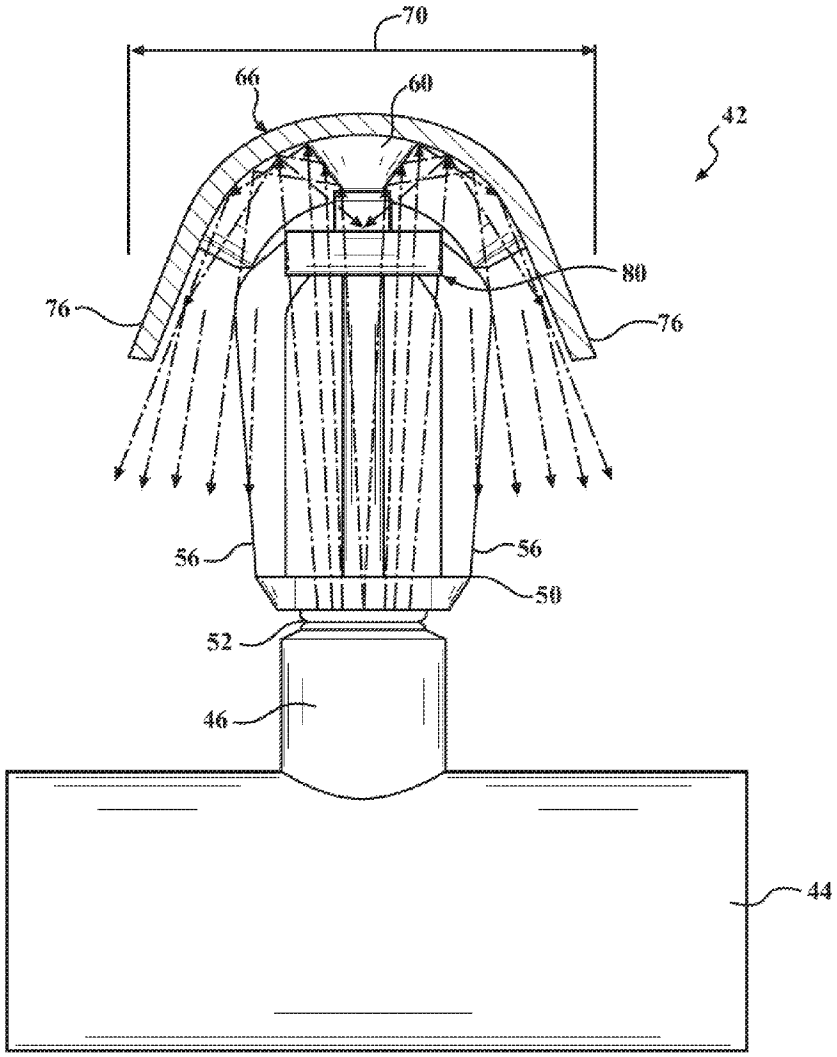
FIG. 16 is a cross-sectional view of the fire sprinkler taken generally along lines 16-16 of FIG. 14 depicting distribution of the fire suppressing liquid along the minor diameter of its non-circular coverage area.

Returning again to FIGS. 10-13, the frame 50 is shown further including a pair of columns 56. The columns 56 extend upwardly from the fastener 52, and are disposed on opposite longitudinal sides of the duct 54. In a preferred embodiment, the alignment of columns 56 is in the longitudinal direction, i.e., parallel to the length of the supply line 44. Each column 56 has a distal end that converges toward the distal end of the other column 56 to meet at an apical tip 58. In this manner, the apical tip 58 is disposed generally along the outflow axis A above the duct 54. A spreader 60 is supported above the apical tip 58. The spreader 60 is disposed generally along the outflow axis A above the duct 54. The spreader 60 is shown here having a generally frusto-conical diverging shape to help smoothly redirect the rushing jet or outflow of liquid as shown in FIGS. 15 and 16.

A standard closure 62 plugs the duct 54 to prevent the flow of fire-suppressing liquid therethrough unless and until a fire emergency is detected. A thermally responsive element 64 holds the closure 62 in place until a fire is detected. The thermally responsive element 64 extends between the apical tip 58 and the closure 62, and is disposed generally along the outflow axis A between the columns 56. Both the closure 62 and the thermally responsive element 64 may be of any suitable and commercially available designs. In use, when the thermally responsive element 64 is exposed to a sufficiently elevated temperature or other specified indicator of fire conditions, the thermally responsive element 64 will yield thus allowing the fluid pressure pushing in opposition against the closure 62 to overcome and forcefully expel the closure 62 so that fire suppressing fluid rushes out through the duct 54 along the outflow axis A as shown in FIGS. 15 and 16.

Figure 12:
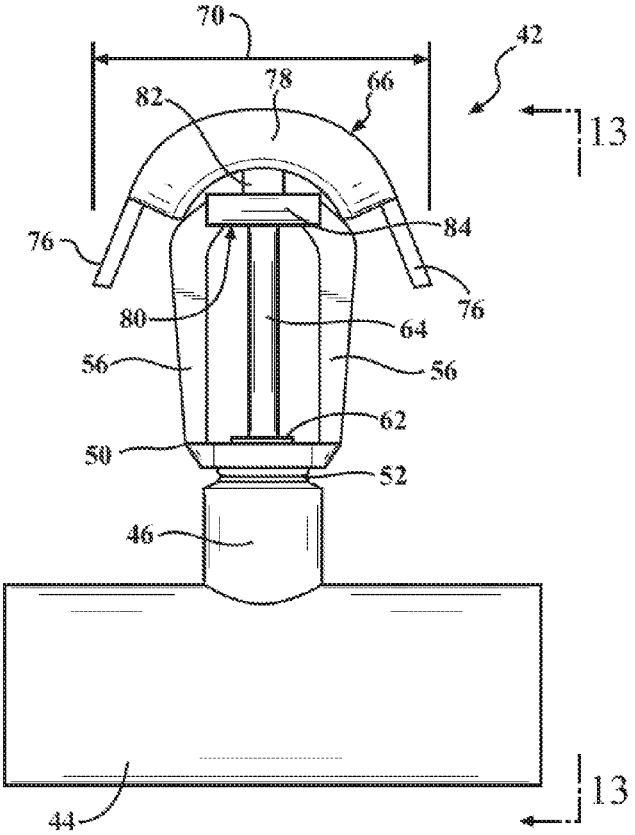
FIG. 12 is a side elevation of the fire sprinkler of FIGS. 10 and 11.
Figure 13:
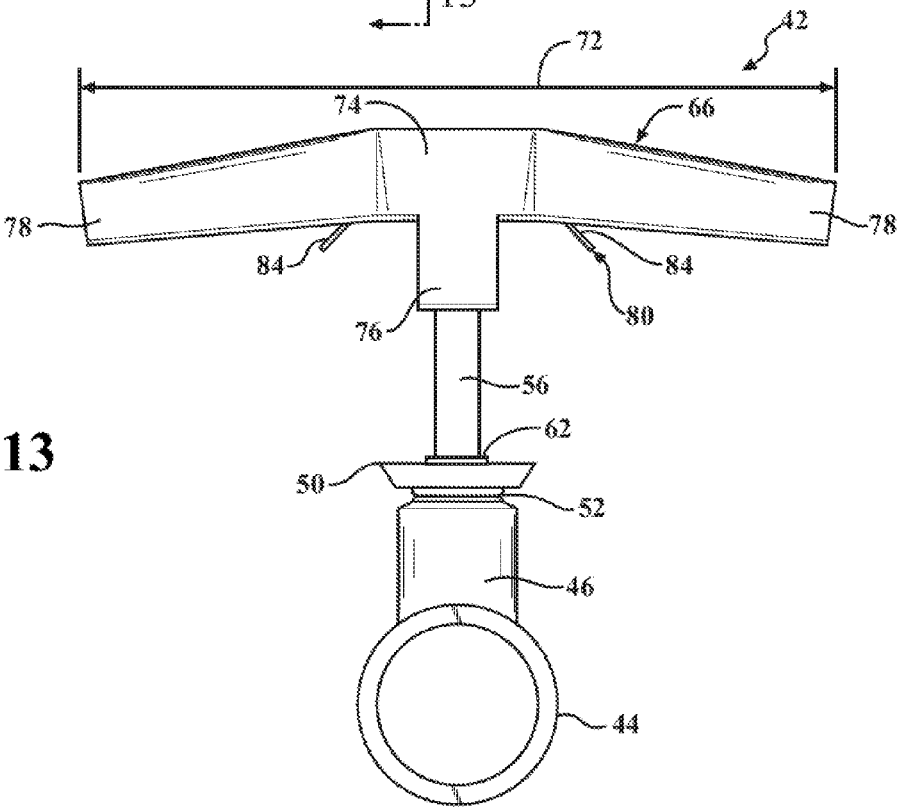
FIG. 13 is a front elevation of the fire sprinkler taken generally along lines 13-13 of FIG. 12.
Figure 14:
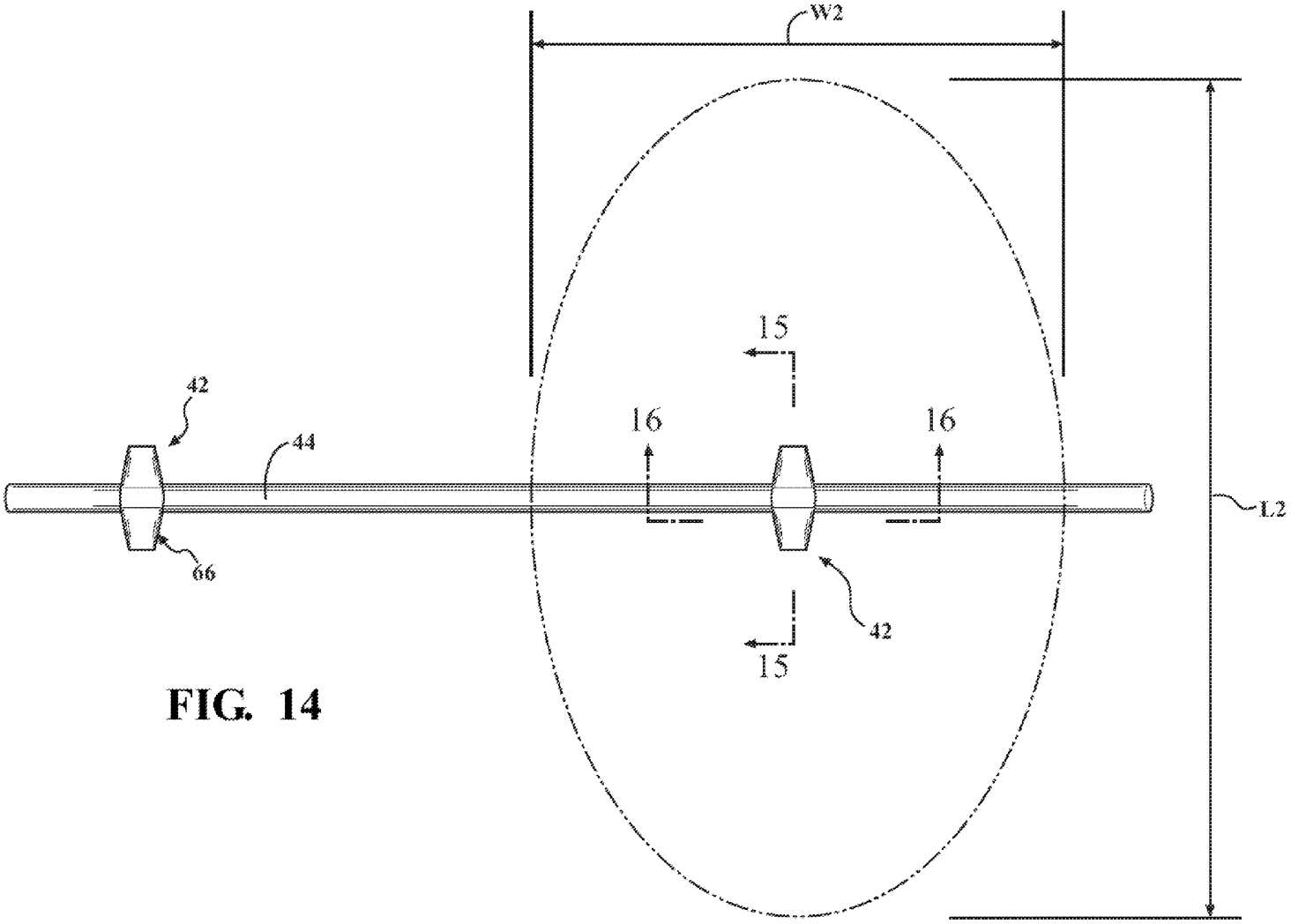
FIG. 14 is a top view of the fire sprinkler of FIGS. 10 and 11 with its non-circular coverage area shown in broken lines having a major diameter generally perpendicular to the supply line and a shorter minor diameter generally parallel to the supply line.
Figure 19:
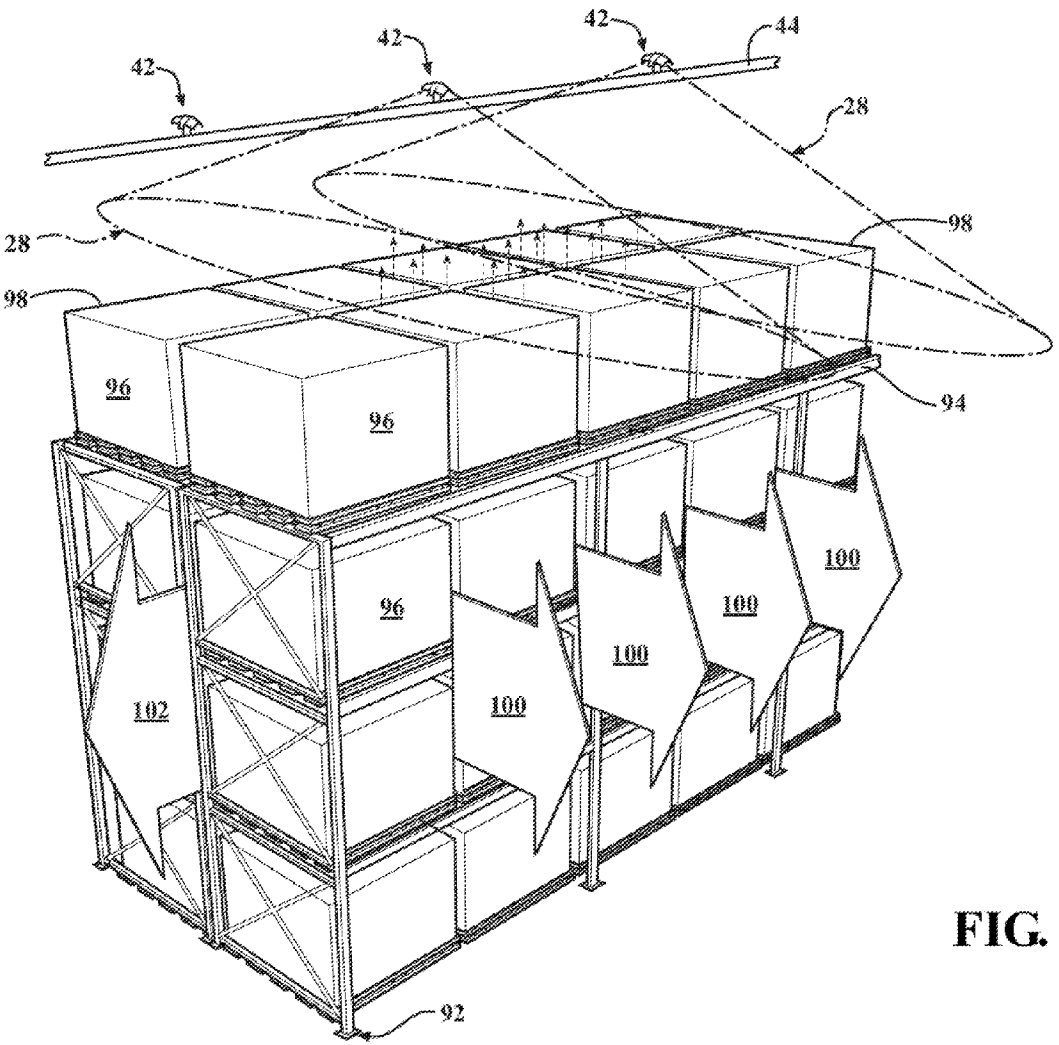
FIG. 19 is a perspective view showing a pair of storage racks arranged back-to-back and a fire sprinkler system according to the present invention arranged relative to the storage rack so that the major diameter of its non-circular coverage area generally coincides with the upper terminal edge of storage items carried on the uppermost shelf.
Figure 20:
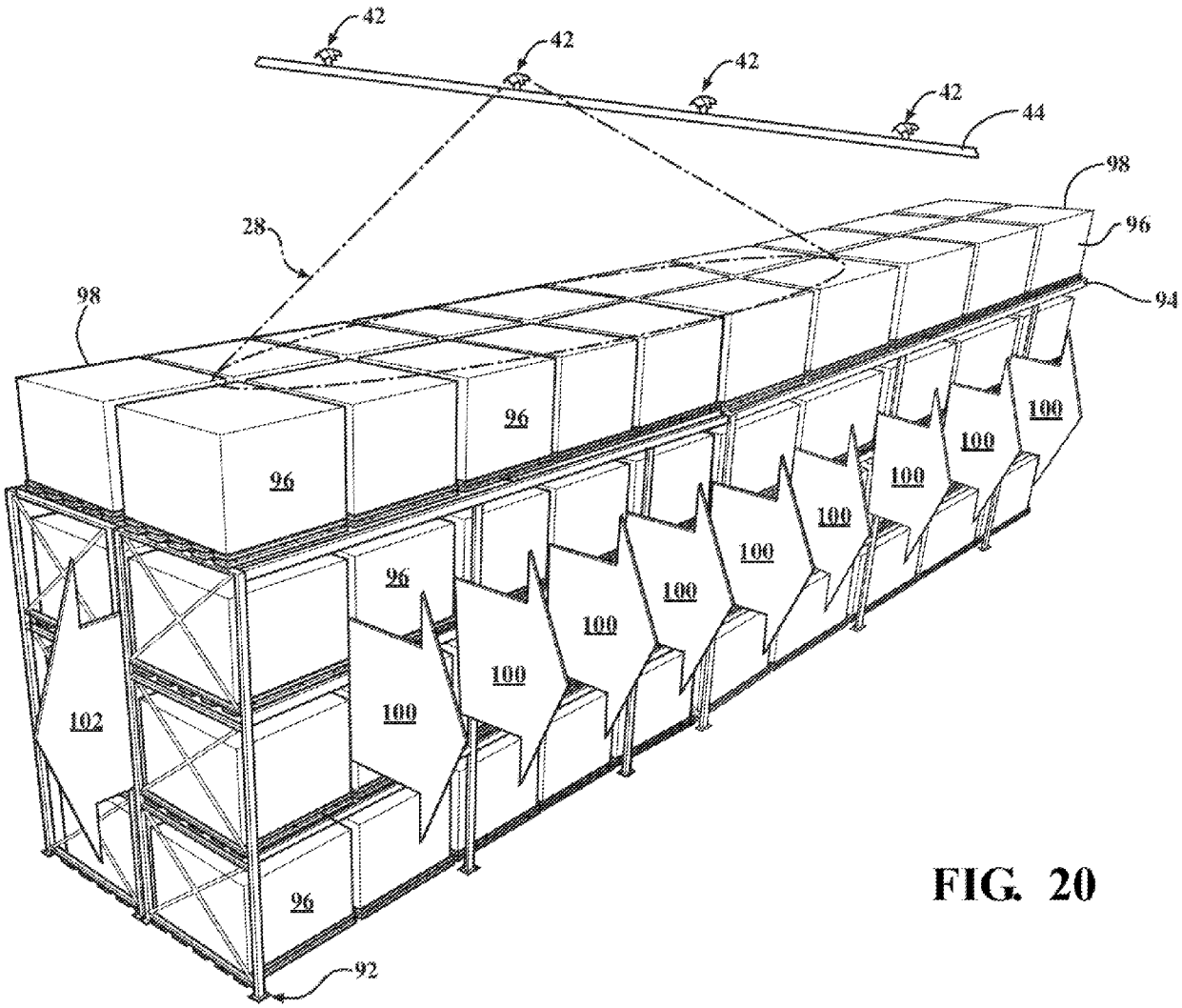
FIG. 20 is a perspective view showing a pair of storage racks arranged back-to-back and a fire sprinkler system according to the present invention arranged relative to the storage rack so that the minor diameter of its non-circular coverage area generally coincides with the upper terminal edge of storage items carried on the uppermost shelf.

The fire sprinkler 42 includes a primary deflector, generally indicated at 66 in FIGS. 10-16. The deflector 66 is shaped and configured to disperse the outflow of fire-suppressing liquid (after the closure 62 has been expelled) in a generally non-circular conical spray to achieve a non-circular coverage area 28, as shown in FIGS. 14, 19 and 20. In a preferred embodiment, the non-circular coverage area 28 has the general shape of an elliptical paraboloid, i.e., tapering outwardly and downwardly as a three-dimensional column of descending liquid spray in which at any horizontal cross-section the perimeter will have a generally elliptical or generally oval shape. As perhaps best shown in FIG. 14, the non-circular coverage area 28 has a major diameter L2, and a shorter minor diameter W2. In the preferred embodiment, the major diameter L2 is set to fall generally perpendicular to the supply line 44, whereas the minor diameter W2 of the coverage area 28 is oriented generally parallel to the supply line 44. As will be described subsequently, this particular orientation, where the major diameter L2 is perpendicular to the supply line 44, enables certain novel and beneficial applications in the fire protection arts. Although the major-to-minor diameter ratio is somewhat variable depending on design conditions, as described below there are particular advantages to establishing about a 3:1 to 6:1 ratio. So for example, if the major diameter (L2) is set to about twenty-five feet, then the minor diameter (W2) is preferably somewhere between about eight feet and four feet. These L2 and W2 dimensions for the coverage area 28 are intended to be exemplary and not in any way limiting.

The deflector 66 is supported above the spreader 60 so that these two features cooperate to redirect the rushing flow of liquid from the outflow axis A into the downwardly projected non-circular coverage area 28. As suggested by FIG. 15, the deflector 66 and spreader 60 could be formed as an integral unit, with a centrally-located screw 68 holding the unitary deflector structure to the apical tip 58. Or alternatively, the deflector 66 and spreader 60 could be formed as discrete elements assembled together into the structure as might otherwise be discerned from viewing FIG. 16. Those of skill in the art will envision reconfiguration of the deflector in cases where the fire sprinkler 42 is used in a pendant-style system (akin to the FIG. 6 embodiment) rather than the upright-style as shown throughout FIGS. 10-22.

The deflector 66 can be seen as having an overall width 70 measured parallel to the supply line 44, as shown in FIGS. 12 and 16. The overall width 70 design characteristics control to some degree the width W2 of the coverage area 28. That is to say, the particular shapes and angles presented at the overall width 70 will have a direct effect on the resulting width W2 of the coverage area 28. Similarly, the deflector 66 has an overall length 72 measured perpendicular to the supply line 44, as shown in FIGS. 13 and 15. The overall length 72 of the deflector 66 is greater than the overall width 70 of the deflector 66 so that the resulting length L2 (i.e., major diameter) of the coverage area 28 is greater than its width W2. And also similarly, design characteristics of the overall length 72 will to an extent control the length L2 of the coverage area 28. Or said another way, specified shapes and angles presented at the overall length 72 directly affect the resulting length L2 of the coverage area 28. As will be described subsequently, both the overall width 70 and overall length 72 of the deflector 66, together with the accompanying design specifications of the deflector 66, are subject to manipulation so that a suitable coverage area 28 can be achieved for a wide range of different applications.

Although many different design schemes are possible for the deflector 66, in the illustrated embodiment the deflector 66 comprises a generally semi-cylindrical body disposed perpendicularly to the outflow axis A. A mid-point of the deflector 66 is generally centered on the outflow axis A, which generally coincides with the screw 68 depicted in FIG. 15. This mid-point of the deflector 66 is contained within a relatively short center section 74 that has a generally semi-cylindrical or half-pipe like shape extending in a direction perpendicular to the supply line 44. That is, the semi-cylindrical extension of the center section 74 is oriented perpendicular to the alignment of the two columns 56, and largely controls distribution of the coverage area 28 in the width W2 (i.e., minor diameter) direction. The center section 74 may optionally be formed with a pair of flap-like ears 76. The ears 76 are rigid and extend from opposite sides of the center section 74 along a generally tangential line from the dished edges of the center section 74. In this manner, each ear 76 is fixed at a skewed angle relative to the outflow axis A. The ears 76 provide a measure of protection to the thermally responsive element 64 from adjacent sprinkler 42 spray so as to reduce the possibility of cold soldering. That is, if an adjacent sprinkler 54 is earlier activated, its fluid spray will be at least partially rebuffed by the ears 76, passively acting in concert with the columns 56.

The deflector 66 further includes a pair of nozzle-like hoods 78 which control distribution of the coverage area 28 largely in the length L2 (i.e., major diameter) direction. The hoods 78 extend in opposite directions from the center section 74 to respective outermost edges, and thereby establish the overall length 72 of the deflector 66. In the illustrated example, the hoods 78 are arranged to extend generally perpendicular to the supply line 44, i.e., transverse to the alignment of the two columns 56. Each hood 78 adjoins the center section 74 with near identical semi-circular geometry, and then tapers or narrows from this maximum dimension to a minimum dimension adjacent its outermost edge. That is, the hoods 78 may be somewhat funnel-like in their influence to converge and accelerate the flow of liquid toward the elongated length L2 of the coverage area 28. The hoods 78 are rigid, and preferably unitary with the center section 74. In this manner, dispersed fire suppressing liquid, e.g., water, will be projected into the distant corners of a non-circular coverage area 28 having a relatively long length L2 (major diameter) and a smaller width W2 (minor diameter). In the preferred embodiments, this non-circular coverage area 28 is generally elliptical or oval, but other non-circular shapes like rectangles and elongated octagons and diamonds are possible.

An optional baffle, generally indicated at 80, may be supported on the apical tip 58 below the deflector 66. The baffle 80 is perhaps best shown in FIGS. 10-13, 15 and 16 having a pair of extension arms 82 cantilevered in opposite outward directions from the apical tip 58. The extension arms 82 are arranged to lie parallel to the hoods 78, i.e., perpendicular to the supply line 44. At the outer distal end of each extension arm 82 is a shield 84. In the illustrations, each shield 84 is shown having a generally rectangular body, however other shapes are certainly possible, and may be optimized in both shape and angle to achieve more effective functionality. Each shield 84 is therefore supported from a respective extension arm 82 and may be oriented at a skewed angle relative to the outflow axis A. In use, the baffle 80 provides two beneficial functions. Prior to activation of the fire sprinkler 42, its baffle 80 provides a measure of passive protection to the thermally responsive element 64 from the spray of an adjacent sprinkler 42 so as to reduce the possibility of cold soldering. In cases where an adjacent sprinkler 54 is earlier activated, the incoming fluid spray will be at least partially deflected by the shields 84. After activation of the fire sprinkler 42, the baffle 80 can assist like a flow control vane to help evenly distribute fire suppressing liquid within the coverage area 28 as shown in FIG. 15.

Turning now to FIGS. 17-22, the interior storage space of a building structure is shown. The building structure may be a warehouse like that shown for example in FIGS. 3 and 4 having a floor 86, and at least three beams 22 suspended over the floor 86. The beams 22 are typically arranged parallel to one another and spaced evenly apart by an interior length L1. In this example, the three beams 22 may be consider first, second and third beams 22, with the second beam being disposed in between the first and third beams 22. Each beam 22 is supported by a pair of substantially vertical uprights or posts 88 spaced apart from one another by an interior width W1. In some constructions, purlins 90 may be placed perpendicularly across the beams 22 to support a ceiling or roof (not shown). In the example of FIG. 3, the ceiling or roof is oriented at a skewed or pitched angle relative to the floor 86, however flat roof constructions are also certainly possible. The first and second supply lines 44 are illustrated in FIGS. 3 and 4. The first supply line 44 is arranged generally parallel to the second supply line 44. The spacing between the first supply line 44 and the second supply line 44 is approximately equal to the major diameter L2 of the coverage area 28 when measured at a specified design height, such as at the overall height of a hypothetical or industry-standard storage item stored below. Because of the wide spacing between adjacent supply lines 44 enabled by the novel spray heads 42 of this invention, the installer is afforded substantially greater freedom to locate supply lines 44 far from the beams 22 which might otherwise present an obstruction to the spray pattern. See for example in FIGS. 3 and 4 that the supply lines 44 can be set, in many circumstances, so that only one supply line 44 is between each adjacent pair of beams 22. This represents a substantial reduction in the number of supply lines to be installed as compared with prior art systems, and therefore a significant reduction in system/installation costs and long-term maintenance expenses.

Figure 17:
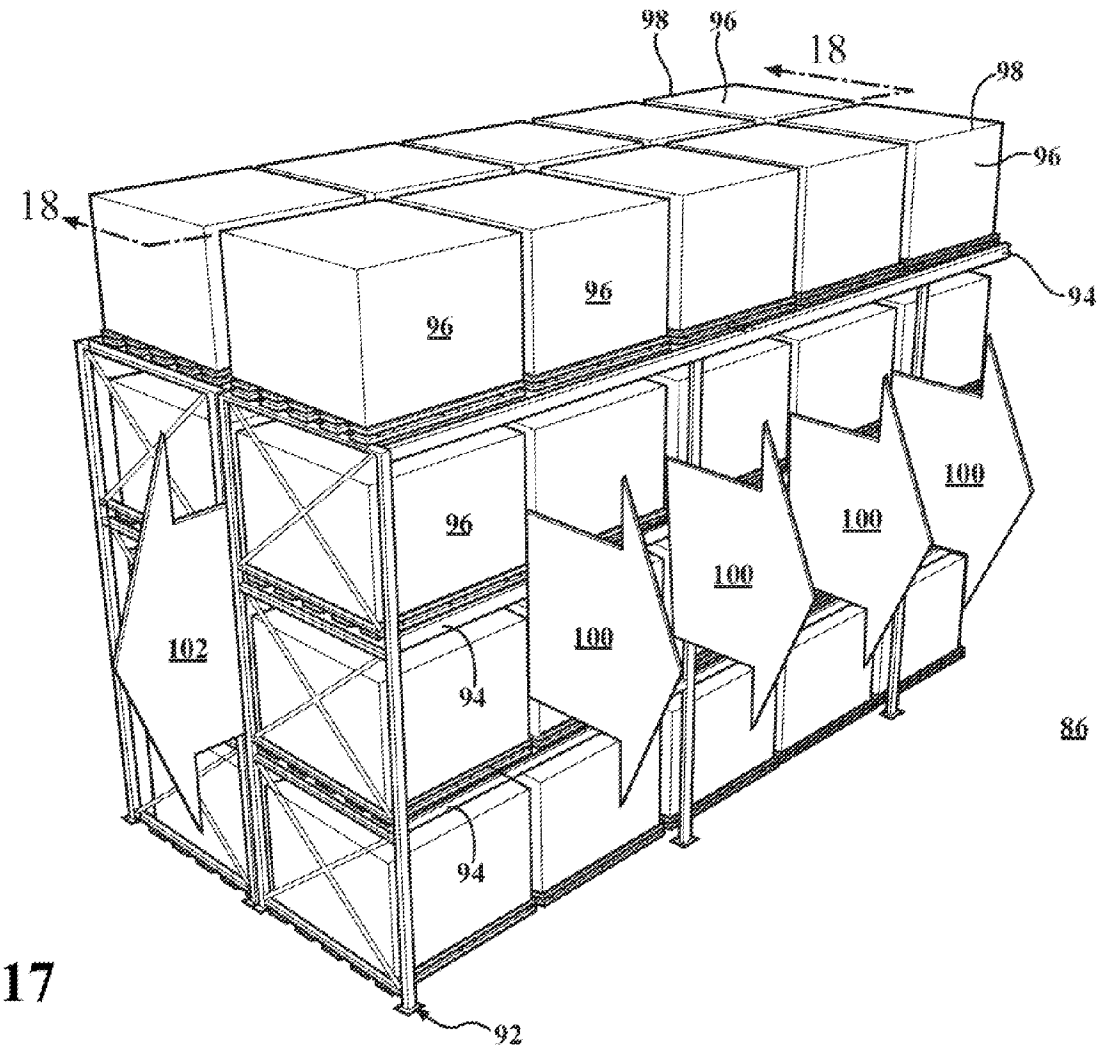
FIG. 17 is a perspective view of a warehouse in which is located four elongated storage racks disposed in pairs arranged back-to-back and each supporting storage items on shelves, the spaces between storage items forming air gaps conducive to fire propagation as identified by wide arrows.

Returning again to FIGS. 17-22, at least one storage item 96 is shown disposed on the floor 86 in the warehouse. In a warehouse, storage items 96 are frequently stacked or arranged in long rows sometimes. Also commonly, the storage items 96 may be placed in elongated storage racks, generally indicated at 92, which in turn are disposed on the floor 86 in the warehouse. In FIG. 17, two such storage racks 92 are shown arranged as a standing pair set back-to-back. This is but one exemplary implementation of a storage rack 92. Commonly, a warehouse facility will arrange many storage racks 92 in back-to-back pairs separated by aisles large enough for a forklift to maneuver. Typically, a forklift aisle is about eight feet wide. However, the aisle may be designed for pedestrian traffic only or otherwise larger or smaller than eight feet. Back-to-back storage racks 92 have a width of about eight-and-a-half feet. In this example, a back-to-back pair of storage racks 92 plus one forklift aisle plus another back-to-back pair of storage racks 92 comprises a storage group and has an overall width of about twenty-five feet. The width measurement of two rows of storage racks separated by an aisle comprises an overall storage group width, which could be wider or narrower than twenty-five feet depending on the configuration given that each storage row may comprise a single storage rack 92, or a back-to-back pair of storage racks 92, or possibly some other configuration of storage racks/units and further that the aisle may be other than eight feet wide. In any event, the overall storage group width is notable, for reasons to be discussed subsequently.

The common storage rack 92 has a plurality of shelves 94 upon which are placed the storage items 96. Oftentimes, the storage items are palletized, or otherwise carried on standard 4×4 pallets to facilitate handling with a forklift (no shown). Of particular note is the overall height of the storage items 96 either standing free or when arranged in rows. When storage items 96 are stacked in shelves 94 of the storage racks 92, the lofty storage items 96 on the uppermost shelf 94 will define the overall height, which is the highest level or region of goods that must be protected by the fire suppression system. That is to say, the coverage area 28 of each fire sprinkler 42 (an indeed all embodiments of fire sprinklers disclosed herein), may be advantageously established with reference to the highest level storage items 96 supported in the storage rack 92, that being referred to herein as the overall height of the storage items 96. Those of skill in the art will appreciate that the illustrated storage configuration as double row racking is but one possible arrangement. Storage racks 92 can be single-row, three (or more) rows, under three feet wide, over eight feet wide up (some storage racks exceed sixteen feet in width!), and even solid pile (i.e., storage items 96 stacked directly on the floor 86 without a supporting rack structure). Indeed, the concepts of this invention are applicable to a wide variety of storage configurations and are not to be limited to just the examples shown in the illustrations.

It may be helpful to consider that the overall height of the storage items 96 represent the generalized overall height of the storage assembly as measured from the floor 86. This overall height correlates to the top surface (or the generalized top surfaces) of the highest elevation storage items 96. The term "generalized" merely refers to a collective average in the case where several non-identical storage items 96 reside on the uppermost shelf 94 or in cases where the storage assembly is configured differently than as illustrated in the figures such as solid pile or the like. In practice, the overall height can vary widely from one application or installation to the next, and therefore a hypothetical overall height or a specified industry-standard overall height may be used or established for purposes of this invention. Furthermore, it may be helpful to consider that the storage items 96 disposed on the uppermost shelf 94 have an upper terminal edge 98 (or generalized terminal edge 98) that extends generally parallel to the elongated storage rack 92.

Within this construct, the fire suppression system is suspended from above in the warehouse, at an elevation that is greater than the overall height of the storage items 96 disposed below. In the event of a fire, wherein it is presumed that the locus of the fire is in or at a storage item 96 somewhere in a storage rack 92, the entire top surface of the storage items 96 disposed on the uppermost shelf 94 must be included in the coverage areas 28 from one or more fire sprinklers 42. Therefore, the major diameter (L2) of the coverage area is preferably set in accordance with the overall height of the storage items 96. Logic dictates that if the entire top surface of the storage items 96 is within a coverage area 28 (or plural overlapping coverage areas), then everything vertically below this top surface will also be within a coverage area 28 so that the fire can be directly combated by the dispersion of fire suppressing liquid. Therefore, the design specifications of the coverage area 28 are advantageously measured at the overall height—be that an actual overall height for a given application, or a hypothetical overall height for a presumed future application, or a specified industry-standard overall height that is commonly used for all or a majority of applications. So if, for example, the overall height for a given application is twelve feet above the floor 86, and the design specification for the coverage area is twenty-five by eight (25×8), then at an elevation of twelve feet above the floor 86 the outer perimeter of the coverage area 28 should measure very close to a twenty-five foot major diameter (L2) and an eight foot minor diameter (W2).

Furthermore, and continuing still with reference to FIG. 17, the typical paired back-to-back arrangement of storage racks 92, and the typical placement of palletized storage items 96 on the various levels of shelves 94 in the storage racks 92, establish a plurality of transverse flues 100 and one longitudinal flue 102. These flues 100, 102 are indicated by wide directional arrows (also in FIGS. 19 and 20). Naturally, such flues 100,102 can exist in solid-pile (non-racked) type storage arrangements. The transverse flues 100 are formed in the gaps between adjacent storage items 96. The longitudinal flue 102 is created in the gap between two storage racks 92 when arranged back-to-back. The importance of these flues 100, 102 becomes relevant when a fire is present in or adjacent one of the storage items 96. Perhaps a worst-case scenario in terms of fire suppression is when a fire originates between two storage racks 92 arranged back-to-back (i.e., in the longitudinal flue 102 area) at or near the floor 86. This is the most distant and difficult to reach region for fire suppressing liquid dispersed from a fire sprinkler 42.

Figure 18:
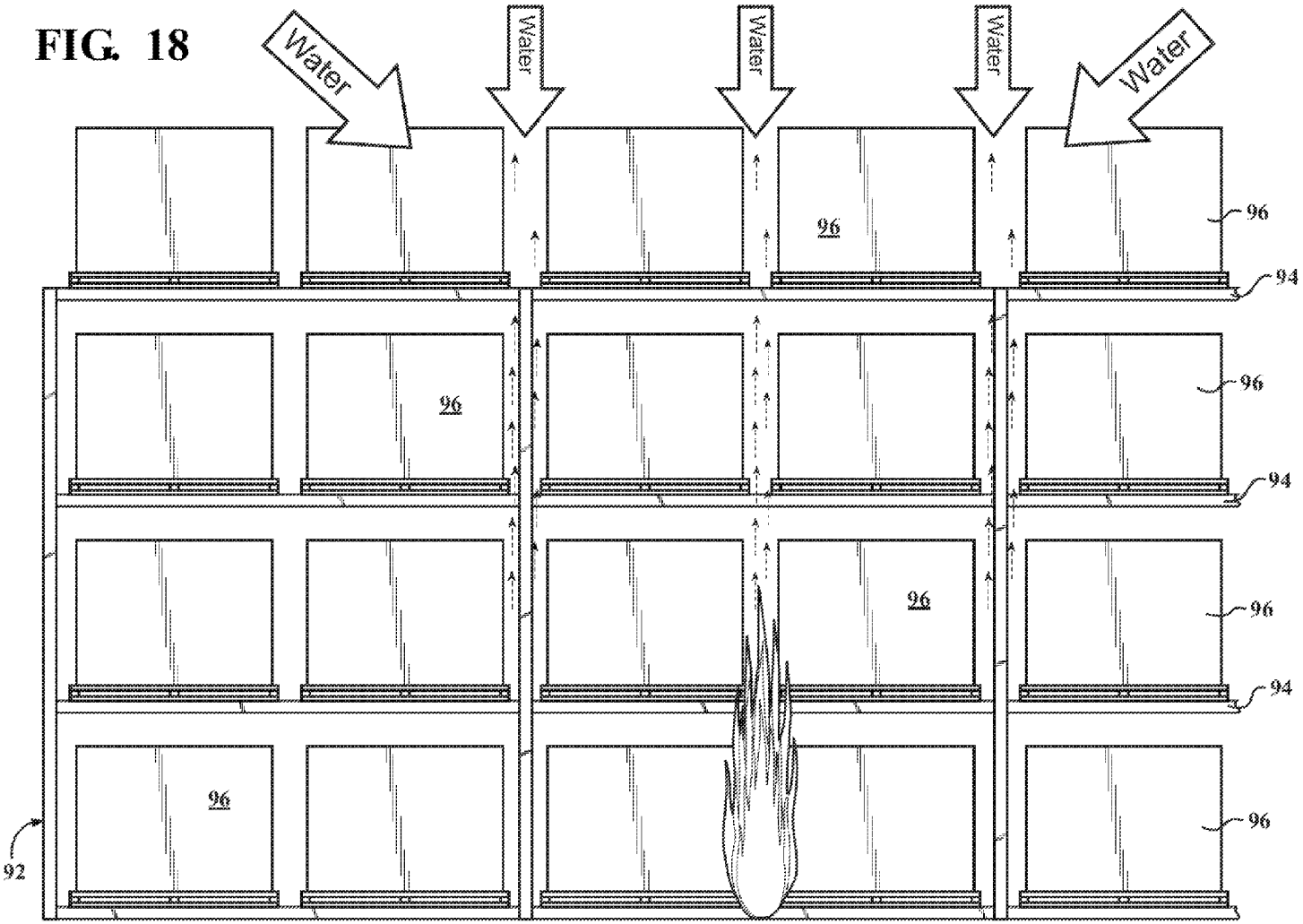
FIG. 18 is a view taken generally along lines 18-18 in FIG. 17 to expose the narrow space between two back-to-back storage racks, and showing the locus of a fire whose hot gases travel upwardly though the air gaps formed in the spaces between storage items.

FIG. 18 depicts such a worst-case scenario. The fire produces hot combustion gases that travel upwardly through the narrow flues 100, 102 like a chimney. When the escaping heat is sufficient to activate at least one nearby overhead fire sprinkler 42, water (or other fire suppressing liquid) will be discharged into the region. In order to be effective, the water must travel down the very same flues 100, 102 through which heat from the fire is rising up. The rising heat, concentrated within the narrow passageways of the flues 100, 102, will vaporize the descending water spray unless sufficient quantities of water and/or large enough droplet sizes can be applied to overpower the heat. The greatest success at fire suppression will be achieved when, at the initial stages of a fire, a maximum amount of water is applied to the flues 100, 102 directly above the fire locus.

FIGS. 19 and 20 illustrate how the present sprinkler system can be configured and arranged relative to the overall height of the storage items 96 so that, at all stages of a fire but particularly at the initial stages, a maximum amount of water is applied to the flues 100, 102 laying directly above the fire so that very little spray is wasted dousing nearby (non-burning) storage items 96. In particular, the sprinkler system of this invention may be arranged so that the major and minor diameters of the non-circular coverage area 28 generally align with the flues 100, 102. That is to say, where the major diameter (L2) is either parallel to or perpendicular to the row of storage items 96. FIG. 19 portrays the scenario where the major diameter, i.e., length L2, of the coverage area 28 is generally parallel with the transverse flues 100, and the minor diameter (W2) is parallel with the longitudinal flue 102. FIG. 20 shows the alternative scenario where the minor diameter, i.e., width W2, of the coverage area 28 is generally parallel with the transverse flues 100, and the major diameter (L2) is parallel with the longitudinal flue 102. In both cases, the density of water laid into the flues 100, 102 will be greater than that achieved by a prior art circular coverage area that is spread over a larger region.

Furthermore, reference to FIGS. 19 and 20 will emphasize the novel water curtain effects that are capable of being produced by the present invention. Consider for example FIG. 20, which shows only a single sprinkler head 42 activated over the row of storage racks 92. If, instead of one sprinkler head 42, two or three sprinkler heads 42 are activated, the aisles on one or both sides of the affected storage racks 92 will receive a substantial, concentrated downward wall of water which will behave like a water curtain to resist spread of the fire to adjacent storage racks 92. A similar effect will be achieved in the perpendicular orientation of FIG. 19. In comparing to a prior art fire sprinkler in which a round coverage area is produced, no such focused and concentrated water curtain effect will be achieved due to the wide, even distribution of water about the coverage area. In the event of fire in a storage rack 92, the activated fire sprinklers 42 will create a beneficial water curtain in the adjacent aisles to discourage fire spread, thereby helping to contain the fire in the smallest possible region. Due to this long pattern, i.e., the elongated or elliptical coverage area 28, adjacent storage will be better protected by the wetting and the curtain water wall.

Figure 21:
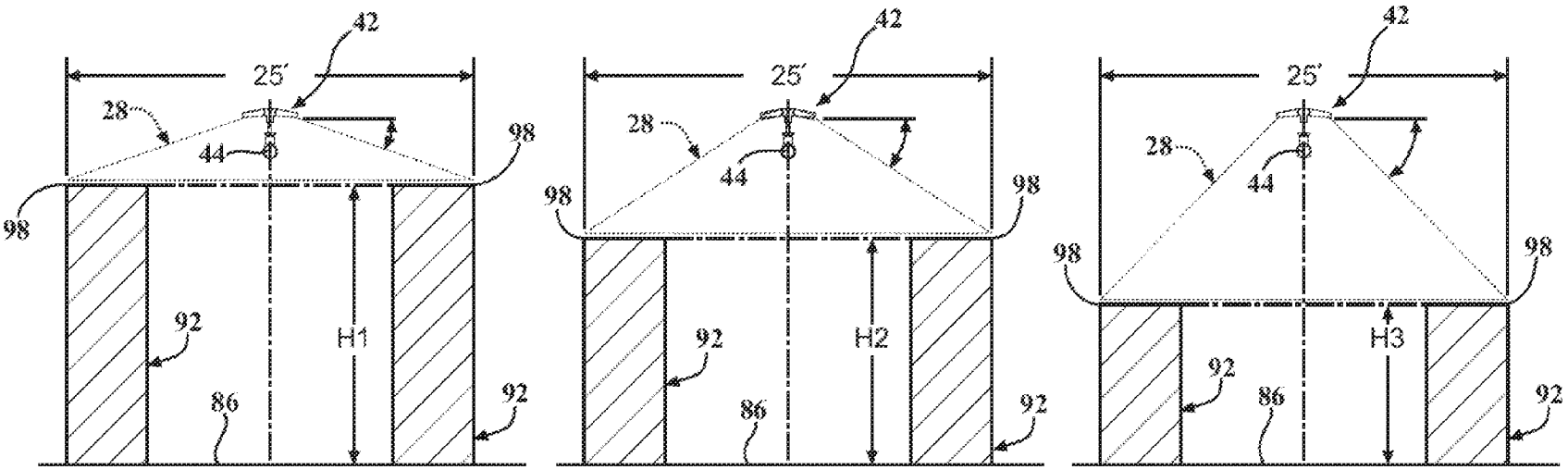
FIG. 21 is a simplified view showing three different fire sprinkler system and storage rack height relationships and the manner in which the non-circular coverage area is manipulated so that at either the major or minor diameter of the non-circular coverage area generally coincides with the upper terminal edge of storage items carried on the uppermost shelf.

This invention is uniquely designed to combat fires in warehouse settings where storage items 96 are tightly stacked or arranged and water from activated fire sprinklers 42 must travel into narrow flues 100, 102 to reach a fire. FIG. 21 shows three different storage situations each with an associated fire sprinkler system. The three storage situations differ from one another in that overall heights of the storage items 96, as represented by upper terminal edges 98, relative to the suspended height of the fire sprinkler system are different. Note that somewhat exaggerated proportions are depicted in order to better illustrate the concepts of this invention. In each of the three storage examples, single banks of storage racks 92 are separated by an aisle. Again, the proportions in this figure are not to scale and the banks of storage racks 92 could be any configuration including, but not limited to, back-to-back pairs of storage racks 92 and solid pile arrays of storage items 96. In cases where the banks of storage racks 92 comprise back-to-back pairs having a width of about eight-and-a-half feet, and that a standard forklift aisle is about eight feet wide, the overall storage group width is about twenty-five feet. Of course, other storage configurations could have a different overall width.

Preferably, but not necessarily, the preferred major diameter (L2) of the coverage area 28 produced by the sprinkler head 42 intentionally corresponds with the overall storage group width. In the example appearing on the far left-hand side of FIG. 21, the storage items have a relatively high overall height H1 above the floor 86. In the center example, the storage items have an intermediate overall height H2 above the floor 86. On the far right-hand side of this image, the storage items have a relatively low overall height H3 above the floor 86. In each of these settings, the fire sprinkler system is shown at the same elevation and centered over the aisle between the two banks of storage racks 92. The three different overall heights H1, H2, H3 represent the fact that the overall height of storage items 96 can be effectively any height so long as it is vertically below the sprinkler system. While a centered location of the fire sprinkler system is certainly possible, in practice it is perhaps more often the case that the fire sprinkler system is not perfectly centered between two banks of storage items 96. Nevertheless, this centered view is effective to illustrate the relationship between the coverage area 28 and the height/span of the storage racks 92, which relationship transcends a centered/non-centered configuration of the fire sprinkler system.

In each of these three examples (H1, H2, H3), the length L2 of the coverage area 28 is about twenty-five feet, and the width W2 is in the range of about four-to-eight feet. However, neither L2 nor W2 should be limited to these measurements. In other applications, the length measure L2 is selected either independently or in relation to the underlying storage configuration, and the width measure W2 of the coverage area 28 is preferably between about 15-67 percent of the length measure. More preferably, an even narrower width measure W2 will be selected to be in the range of about 15-30% (i.e., ~⅙-⅓) of the major diameter L2. Less demanding storage occupancies will generally accommodate a wider coverage area 28 (i.e., closer to ⅓ of the major diameter L2), whereas more demanding storage arrangements will generally demand a narrower coverage area 28 (i.e., closer to ~⅙ of the major diameter L2). In some applications, it may even be possible to expand the minor diameter width measure W2 about 67% (i.e., ~⅔) of the major diameter L2. However, because the distance between the fire sprinkler 42 and the overall height (H1, H2 or H3) varies, it may be desirable to alter the internal spread angle of the tapering three-dimensional column of descending liquid spray.

In one example, the non-circular coverage area 28 is altered so that the major diameter (L2) of the non-circular coverage area 28 is between about twelve and twenty-five feet as measured at the overall height (H1, H2 or H3) of the storage items. When the major diameter (L2) of the non-circular coverage area 28 is held to this range, and concurrently when the minor diameter is restricted to a range of about 15-67% (i.e., ~⅙-⅔) of the major diameter L2, sufficient water velocity can be generated to create nozzle-like projections of water spray that will penetrate into the flues 100, 102. The narrow width measure W2 allows spray heads 421 to be stationed closer together along a common supply line 44, which in turn increases chances that multiple spray heads 42 will be activated and thereby apply more water into the flues. Furthermore, water droplet size and water velocity will be increased, which helps to force more water in a narrow spray pattern that will infiltrate the flues 100, 102 against a counter-flow of heat from the fire.

Because water pressure has a direct effect on the actual size of the coverage area 28, and because water pressure will diminish as more fire sprinklers 42 are activated, there is a need to design a fairly generous overlap—on the order of one to three feet—for a single-activated fire sprinkler 42. It is therefore understood that as water pressure diminishes due to additional fire sprinklers 42 being activated, the modestly shrinking coverage area 28 will remain in an overlap condition with the next adjacent coverage area 28. Therefore, the degree of overlap needed between adjacent coverage areas 28 is preferably calculated for each installation based on line pressure, supply line 44 sizes and other relevant factors.

Figure 22:
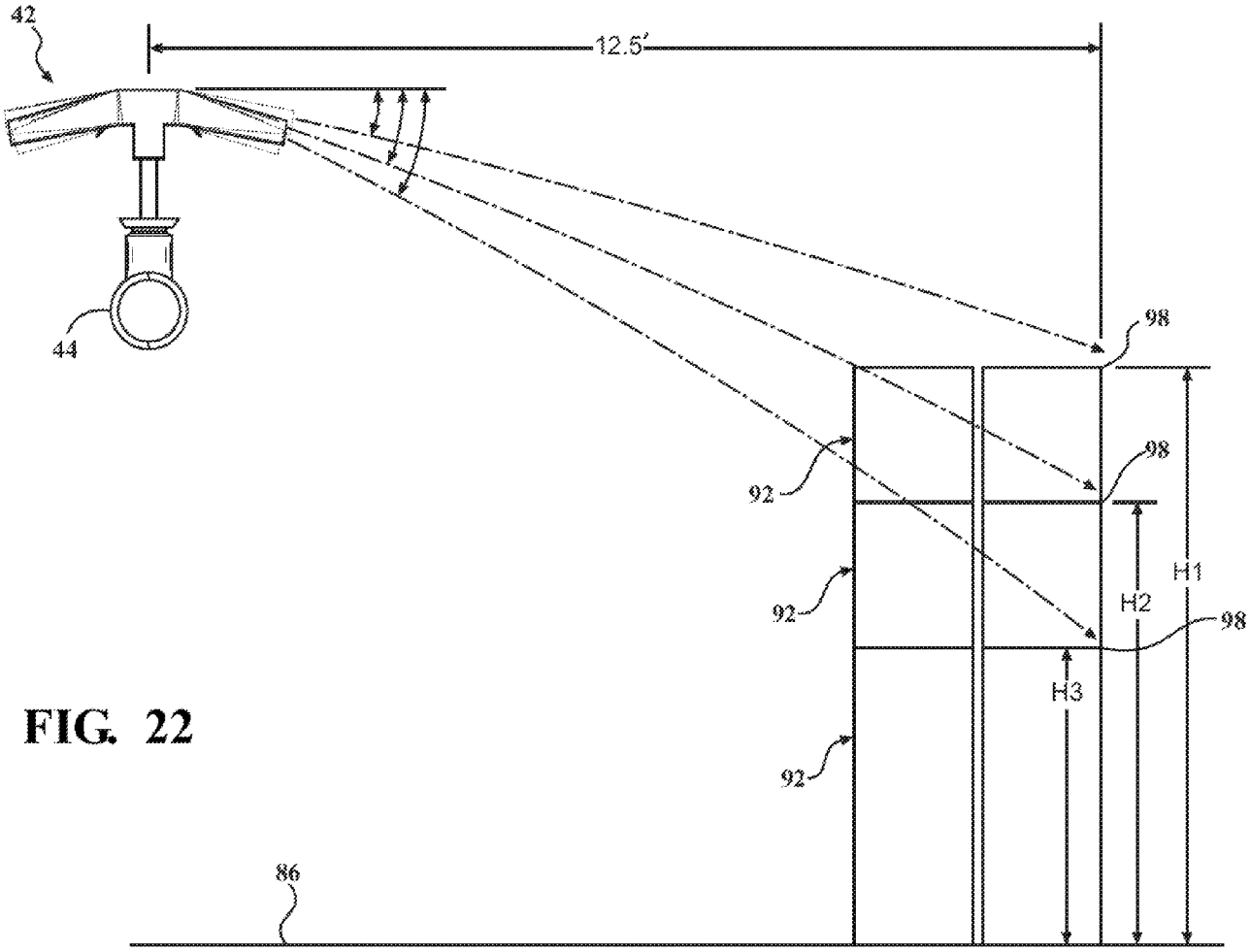
FIG. 22 is another simplified view again showing three storage rack height relationships relative to the same fire sprinkler system and the manner in which the non-circular coverage area is manipulated so that the major diameter of the non-circular coverage area generally coincides with the highest outer edge of the storage rack and/or storage items carried thereon.

FIG. 22 is another simplified view showing three storage rack height relationships as in FIG. 21, but superimposed against one centrally located fire sprinkler 42 in order to illustrate the change that is made to the internal spread angle of the coverage area 28 so that its length L2 (i.e., major diameter) generally coincides with the overall height of storage items 96 below. In each example (H1, H2, H3), the non-circular coverage area 28 is manipulated so that the major diameter (L2) is measured at the overall height (H1, H2 or H3) of the storage items, and the minor diameter is about 15-67% (i.e., ~⅙-⅔) of the major diameter L2.

Manipulation of the coverage area 28 is accomplished by changing the deflector 66 and/or baffle 80 as shown here in phantom lines. Slight but effective alterations to the shape and/or angle of the hoods 78 and/or ears 76 and/or baffle 80 relative to the center section 74 will have the desired effect. In practice, a variety of different pre-manufactured deflector 66 and/or baffle 80 configurations can be offered—each rated for a different overall storage item height to sprinkler relationship. For example, the company may offer a first choice deflector 66 and baffle 80 for an H1 application, a second choice deflector 66 and baffle 80 for an H2 application, and a third choice deflector 66 and baffle 80 for an H3 application. More or fewer angular choices may of course be offered to accommodate a wide variety of storage configurations/overall height criteria. Alternatively, the deflector 66 could be made adjustable (not shown) in the field to set the hoods 78 and/or ears 76 and/or baffle 80 according to the instant needs. The minor diameter dimension (W2) of the coverage area 28 can also be manipulated by altering its width characteristics, including the size, shape and angle of the ears 76. It should also be noted that the deflector 66 and/or baffle 80 design specifications can be influenced as well to suit particular storage occupancy needs. Less demanding storage occupancies may accommodate wider coverage areas 28 whereas more demanding storage arrangements will demand closer/smaller coverage areas 28.

Accordingly, the present invention proposes an application-specific pairing of a fire sprinkler 42 to a particular warehouse storage condition or anticipated storage condition. The pairing brings into alignment the orientation of the major/minor diameters with respect to the flues 100, 102, as well as the vertical distance between overall storage item height and sprinkler heads 42. The intent is to conform the non-circular coverage area 28 of the sprinkler system to completely overlap the underlying storage items with the highest degree of hydraulic efficiency. Once this internal angular spread is specified to reach a preferred major diameter L2 and proportionately smaller minor diameter W2 based on overall height of the storage items, then actual installation practice does not mandate that the fire sprinklers 42 are centered in an aisle between banks of storage racks 92. And furthermore, the major/minor diameters should be set parallel with respect to the flues 100, 102 however acceptable results may be achieved even if set askew.

The overall fire suppression system will include a complete network of supply lines 44 and regularly-spaced sprinkler heads 42 that usually have the ability to completely and entirely blanket the building footprint. The design protocol described herein will establish the proper deflector 66 specifications with proper internal angle to achieve a preferred major diameter (L2) of the coverage area 28 at the overall storage item height, and a minor diameter (W2) that is about 15-67% of L2, or more preferable about 15-33% of L2.

Through large scale fire tests, where fire suppressing systems and fire sprinkler components are evaluated in a scientific setting, fire control has been proven to be most effective by maximizing the following system variables: water discharge velocity, k factor and water droplet size. Fire control is typically improved by: greater water velocity, higher k factor and/or larger water droplet size. The elongated nature of the coverage area 28, where the major diameter (L2) is significantly greater than the minor diameter (W2), produces a pattern that more closely mimics a fire hose stream projected in opposite directions. This, in turn, produces larger water droplet size and increases water discharge velocity, while operating at less pressure and volume. Larger water droplets are beneficial because they are less sensitive to the heat rising through the flues 100, 102. That is, larger droplets better penetrate through the flues 100, 102 to reach the fire. Likewise, higher velocity water spray also penetrates the narrow flues 100, 102 as compared with slower moving water spray. The oriented major/minor diameters of the coverage area 28 vis-à-vis the flues 100, 102 help to improve chances that this beneficial fire hose effect casts high volumes of waters into the affected flues 100, 102.

The relatively narrow widths W2 (minor diameters) of the coverage areas 28 enable relatively close spacing of the fire sprinklers 42 along the supply line 44. (As will be described subsequently, narrow spacing can be an advantage rather than a detriment.) However, the lateral spacing between adjacent supply lines 44 can be increased as compared with prior art designs. This close spacing of heads 42 along the same supply line 44 provides numerous key benefits, perhaps chief among which is an improved ability to penetrate the fire flues 100, 102. The unique design of the fire sprinkler 42, where the deflector 66 includes nozzle-like hoods 78 that are oriented parallel to either the transverse flues 100 or the longitudinal flue 102, enables a more precise aim directly into the fire flues 100, 102 thus resulting in a more efficient fire suppression system with the sprayed water in large quantities going where it is most needed.

Furthermore, the unique design of the fire sprinkler 42 provides important hydraulic advantages. In installations where the minor diameter (W2) is about ⅓ of L2 (e.g., about eight feet when L2 is about twenty-five feet), the recommended spacing interval between sprinkler heads 42 along the supply line 44 is preferably about six-to-eight feet. In installations where the minor diameter (W2) is about ⅙ of L2 (e.g., about four feet when L2 is about twenty-five feet), the recommended spacing interval between sprinkler heads 42 along the supply line 44 is preferably about four-to-five feet. If there is particular concern about sensitivity, where too many sprinkler heads 42 might go off because they are so close together, the wider (six-to-eight foot) W2 spacing can be chosen. In counterpoint to this sensitivity concern, however, it may be prudent to encourage a condition where more sprinkler heads 42 are activated rather than fewer, by setting the sprinkler heads 42 on four-to-five foot centers and specifying a four-to-five foot minor diameter W2 when L2 is about twenty-five feet. Two comparative examples will illustrate the benefits of this approach.

Example 1

A sprinkler head 42 has a coverage area 28 with a twenty-five foot major diameter (L2) and an eight foot minor diameter (W2). The k-factor is k=17. At a steady 52 psi line pressure, this sprinkler head 42 will distribute approximately 122.58 gpm.

Example 2

A sprinkler head 42 has a coverage area 28 with a twenty-five foot major diameter (L2) and a four foot minor diameter (W2). The k-factor is k=11. At a steady 35 psi line pressure, this sprinkler head 42 will distribute approximately 65.07 gpm.

In Example 1, it may be presumed that only one fire sprinkler 42 will activate because of the greater spacing (six-to-eight feet) between adjacent spray heads 42. This single activated spray head 42, fed by 52 psi line pressure, will deliver approximately 122.58 gpm onto the fire. However, in Example 2, it may be presumed that two fire sprinklers 42 will concurrently activate because of the closer spacing (four-to-five feet) between adjacent spray heads 42. These two activated spray heads 42, fed by a modest 35 psi line pressure, will combine deliver approximately 130.15 gpm onto the fire. Thus, two spray heads 42 operating at lower supply line 44 pressure can deliver water at a greater rate onto a fire than can a single spray head 42 fed by a higher line pressure. And in addition to the advantageous lower starting pressure, two spray heads 42 according to this invention will have a greater chance of avoiding obstructions and a greater chance of penetrating the fire flues because of the tighter spacing (100 vs 200 sq ft).

The implications of this reality are significant. Perhaps most notably, the number of supply lines 44 can be reduced with the possibility of reducing volume as well. Whereas supply lines for a typical prior circular coverage area system are set approximately ten-to-twelve feet apart, supply lines 44 of the present invention are set at about the same distance as the major diameter (L2), which in the preceding examples would be about twenty-five feet in most cases. Spacing supply lines 44 set apart by twenty-five feet represents about a 66% reduction in both material costs and labor/installation costs. In some cases, supply lines 44 of smaller diameter, which are less costly on a number of levels, can even be used. Pressure supply resources can be downsized when fewer supply lines 44 are installed. Additionally, the closer spacing of spray heads 42 along a common supply line 44 (made possible by relatively narrow width W2 as compared to long length L2 of the non-circular coverage area 28), means that obstructions (e.g., low-hanging beams 22, columns or other large objects) are not as big of concern to the effective coverage of the spray pattern.

Early stage fire suppression success rates will increase based on the principles of this invention. It is therefore prudent to consider rejecting the conventional wisdom that once indicated widely spacing spray heads, and instead move toward more closely space spray heads, for which the unique fire sprinkler 42 and other principles of this invention are well adapted. The efficient deflector 66 of the present fire sprinkler 42 distributes the water at the needed density using lower line pressure at k-factors in the 11-14 k range. This, in turn enables activation of two heads 42 (spaced for example about four-to-five feet apart on the same supply line 44) instead of one sprinkler head 42, spaced for example on eight foot centers, to achieve a pattern with long throw in the major diameter (L2) directions. The principles of this invention, which permit close-spacing of sprinkler heads 42 and far-spacing adjacent supply lines 44 and possibly even lower line pressures, will not as readily overwhelm the available water supply and yet enable more sprinkler heads 42 to concurrently spray which put more water on the fire. Furthermore, the close spacing of sprinkler heads 42 along a common supply line 44 means that physical obstructions are not as big of concern to spray pattern. That is to say, because two or three spray heads 42 are more likely to be activated when in the past only one spray head is activated, any physical obstructions—like low beams 22, structural columns, equipment or atypically large objects—will not be as likely to block water spray in cases whether the obstruction is between one spray head 42 and the fire. Furthermore, greater spacing between adjacent supply lines 44 improves the probability that each supply line 44 can be placed in its own bay between adjacent beams 22 as shown in FIGS. 3 and 4 where they will not be as susceptible to blockage by low-hanging beams 22.

As a person skilled in the art of fire suppression and extinguishment will recognize from the previous detailed description and from the figures and claims, that modifications and changes can be made to the preferred embodiments of the invention without departing from the scope of this invention defined in the following claims.

What is claimed is:

1. A fire sprinkler assembly configured to disperse a fire suppressing liquid over a non-circular coverage area, said assembly comprising:

a frame, said frame including a fastener configured to connect with a supply line to receive an outflow of fire-suppressing liquid from the supply line along an outflow axis, a deflector configured to disperse the outflow of fire-suppressing liquid in a generally non-circular conical spray to achieve a non-circular coverage area, said deflector having an overall width and an overall length measured perpendicular to said overall width, said deflector having a mid-point generally centered on said outflow axis, said deflector including a center section containing said mid-point, the non-circular coverage area having a major diameter and a shorter minor diameter generally perpendicular to said major diameter, said overall deflector length being greater than said overall deflector width, said deflector comprising a generally semi-cylindrical body disposed perpendicularly to said outflow axis, wherein said deflector includes a pair of hoods, said hoods extending in opposite directions from said center section to respective outermost edges, said hoods disposed generally parallel to said major diameter, each said hood having a width that tapers from a maximum dimension adjacent said center section to a minimum dimension adjacent said outermost edges.

2. The assembly of claim 1, wherein said center section includes a pair of ears, each said ear extending from an opposite side of said center section, each said ear being oriented at a skewed angle relative to said outflow axis.

3. The assembly of claim 1, wherein said frame includes an apical tip, a baffle supported between said apical tip and said deflector, said baffle having a pair of extension arms extending in opposite outward directions from said apical tip, each said extension arm terminating in a distal end, a shield disposed on each distal end of each said extension arm, each said shield having a generally rectangular body, each said shield being oriented at a skewed angle relative to said outflow axis.

4. The assembly of claim 1, wherein said fastener comprises a threaded exterior body surrounding a duct, said duct configured to receive the outflow of fire-suppressing liquid from the supply line along said outflow axis, said frame further including a pair of columns, said columns extending from said fastener, said columns disposed on opposite longitudinal sides of said duct, each of said columns having a distal end converging toward the other said column to meet at an apical tip, said apical tip disposed generally along said outflow axis above said duct, a closure plugging said duct to prevent the flow of fire-suppressing liquid therethrough, a thermally responsive element extending between said apical tip and said closure, said thermally responsive element disposed between said columns, a spreader supported on said apical tip, said spreader disposed generally along said outflow axis above said duct, said spreader having a generally frusto-conical diverging shape, and a baffle supported on said apical tip, said baffle having a pair of extension arms extending in opposite outward directions from said apical tip, each said extension arm terminating in a distal end, a shield disposed on each distal end of each said extension arm, each said shield having a generally rectangular body, each said shield being oriented at a skewed angle relative to said outflow axis.

5. A fire sprinkler assembly configured to disperse a fire suppressing liquid over a non-circular coverage area, said assembly comprising:

a frame, said frame including a fastener configured to connect with a supply line to receive an outflow of fire-suppressing liquid from the supply line along an outflow axis, a deflector configured to disperse the outflow of fire-suppressing liquid in a generally non-circular spray to achieve a non-circular coverage area, said deflector having an overall width and an overall length measured perpendicular to said overall width, the non-circular coverage area having a major diameter and a shorter minor diameter generally perpendicular to said major diameter, said overall deflector length being greater than said overall deflector width, and wherein said deflector includes a pair of hoods, said hoods extending in opposite directions from said center section to respective outermost edges, said hoods disposed generally parallel to said major diameter, each said hood having a width that tapers from a maximum dimension adjacent said center section to a minimum dimension adjacent said outermost edges.

6. The assembly of claim 5, wherein said deflector comprises a generally semi-cylindrical body disposed perpendicularly to said outflow axis.

7. The assembly of claim 6, wherein said deflector has a mid-point generally centered on said outflow axis, said deflector including a center section containing said mid-point.

8. The assembly of claim 7, wherein said center section includes a pair of ears, each said ear extending from an opposite side of said center section, each said ear being oriented at a skewed angle relative to said outflow axis.

9. The assembly of claim 7, wherein said frame includes an apical tip, a baffle supported between said apical tip and said deflector, said baffle having a pair of extension arms extending in opposite outward directions from said apical tip, each said extension arm terminating in a distal end, a shield disposed on each distal end of each said extension arm, each said shield having a generally rectangular body, each said shield being oriented at a skewed angle relative to said outflow axis.

10. The assembly of claim 7, wherein said fastener comprises a threaded exterior body surrounding a duct, said duct configured to receive the outflow of fire-suppressing liquid from the supply line along said outflow axis, said frame further including a pair of columns, said columns extending from said fastener, said columns disposed on opposite longitudinal sides of said duct, each of said columns having a distal end converging toward the other said column to meet at an apical tip, said apical tip disposed generally along said outflow axis above said duct, a closure plugging said duct to prevent the flow of fire-suppressing liquid therethrough, a thermally responsive element extending between said apical tip and said closure, said thermally responsive element disposed between said columns, a spreader supported on said apical tip, said spreader disposed generally along said outflow axis above said duct, said spreader having a generally frusto-conical diverging shape, and a baffle supported on said apical tip, said baffle having a pair of extension arms extending in opposite outward directions from said apical tip, each said extension arm terminating in a distal end, a shield disposed on each distal end of each said extension arm, each said shield having a generally rectangular body, each said shield being oriented at a skewed angle relative to said outflow axis.

* * * * *